US005425399A

United States Patent [19]

Shindo et al.

[11] Patent Number: 5,425,399

[45] Date of Patent: Jun. 20, 1995

[54] WEFT PICKING SYSTEM FOR JET LOOM WITH DEVICE FOR DEFORMING A WEFT YARN SLACKENED PORTION

[75] Inventors: Akio Shindo, Hachioji; Takao Ishido, Higashikurume; Takatugu Kato, Tokyo; Ryozo Yuzawa, Akishima; Masaichi Nishijima; Yuji Kato, both of Tokyo; Nobuhiko Hayashi, Hamura; Takashi Ogasawara, Kanagawa; Kenichi Nakajima, Tokyo; Tetsuhiro Kajiwara, Ayase; Shogo Sasaki, Ome, all of Japan

[73] Assignee: Nissan Texsys Co., Ltd., Tokyo, Japan

[21] Appl. No.: 227,650

[22] Filed: Apr. 14, 1994

[30] Foreign Application Priority Data

Apr. 16, 1993 [JP] Japan ..... 5-089854

[51] Int. Cl.[6] ..... D03D 47/34

[52] U.S. Cl. ..... 139/450; 139/452; 139/453; 139/194; 139/435.1

[58] Field of Search ..... 139/450, 452, 453, 194, 139/435.1

[56] References Cited

U.S. PATENT DOCUMENTS 4,962,796 10/1990 Grimm et al. ..... 139/450
5,154,209 10/1992 Takegawa .
5,295,516 3/1994 Tanaka et al. ..... 139/453 X

FOREIGN PATENT DOCUMENTS 0268550 5/1988 European Pat. Off. ..... 139/450
3714826 6/1988 Germany ..... 139/450
57-199841 12/1982 Japan .
4-136237 5/1992 Japan .

*Primary Examiner*—Andrew M. Falik
*Attorney, Agent, or Firm*—Foley & Lardner

[57] ABSTRACT

A weft picking system for an air jet loom is provided with a microcomputer as a controller. The weft picking system comprises a weft traction device including a pair of rollers, one of which is driven by an inverter motor. A weft yarn fed from a weft measuring and storing device can be placed between the rollers to be drawn toward a weft posture regulating nozzle. The weft posture regulating nozzle is arranged to project the weft yarn into the shed of warp yarns and regulates the posture of the weft yarn under the influence of air jet ejected from the nozzle and from a plurality of sub-nozzles. The rollers always rotate during a weaving operation of the loom. A change-over device is provided to change the weft yarn from a first state of being placed between the rollers to a second state of separating from the rollers or vice versa. A weft yarn slackened portion is unavoidably formed between the weft traction device and the weft posture regulating nozzle, due to a temporary difference in the tractive speed between the weft posture regulating nozzle and the weft traction device. A slackened portion deforming device is disposed between the weft traction device and the weft posture regulating nozzle to effectively deform the slackened portion in a manner to smoothen the slackened portion enough as to prevent any trouble in the weaving operation and any defects in the woven fabric.

18 Claims, 24 Drawing Sheets

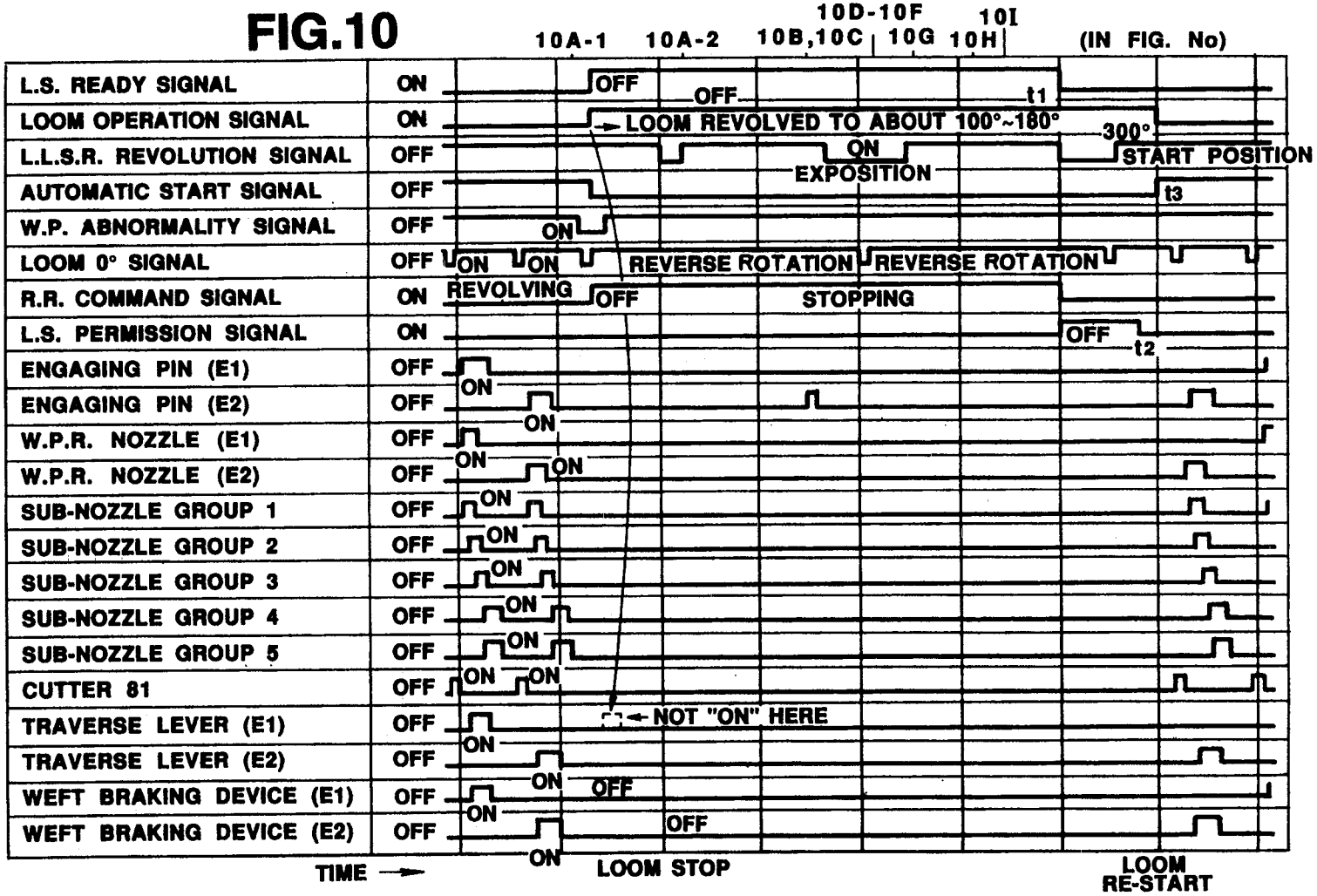
FIG.10
10A-1
10A-2
10B,10C
10D-10F
10G
10H
10I
(IN FIG. No)
L.S. READY SIGNAL
LOOM OPERATION SIGNAL
L.L.S.R. REVOLUTION SIGNAL
AUTOMATIC START SIGNAL
W.P. ABNORMALITY SIGNAL
LOOM 0° SIGNAL
R.R. COMMAND SIGNAL
L.S. PERMISSION SIGNAL
ENGAGING PIN (E1)
ENGAGING PIN (E2)
W.P.R. NOZZLE (E1)
W.P.R. NOZZLE (E2)
SUB-NOZZLE GROUP 1
SUB-NOZZLE GROUP 2
SUB-NOZZLE GROUP 3
SUB-NOZZLE GROUP 4
SUB-NOZZLE GROUP 5
CUTTER 81
TRAVERSE LEVER (E1)
TRAVERSE LEVER (E2)
WEFT BRAKING DEVICE (E1)
WEFT BRAKING DEVICE (E2)
TIME
ON
OFF
t1
t2
t3
LOOM REVOLVED TO ABOUT 100°~180°
300°
START POSITION
EXPOSITION
REVOLVING
REVERSE ROTATION
STOPPING
NOT "ON" HERE
LOOM STOP
LOOM RE-START

WEFT PICKING SYSTEM FOR JET LOOM WITH DEVICE FOR DEFORMING A WEFT YARN SLACKENED PORTION

BACKGROUND OF THE INVENTION

1. Field of the Invention

This invention relates to improvements in a weft picking system for a fluid jet loom, and more particularly to such a weft picking system including a roller type weft traction device between a weft measuring and storing device and a fluid jet nozzle to draw a weft yarn at a high speed toward the fluid jet nozzle.

2. Description of the Prior Art

Fluid jet looms are provided with a weft picking system which is arranged to accomplish a weft picking under the influence of fluid jet ejected from a nozzle or nozzles. This weft picking system accomplishes weft picking at a high speed with the fluid jet and therefore is highly advantageous from the view point of improving productivity of a fabric and availability of the loom. However, for example, in case of accomplishing the weft picking under the influence of air jet, a weft yarn is pulled and flown under a frictional force between air stream and the weft yarn, and therefore such a weft picking system induces large pressurized air consumption (or electric power consumption), and is problematic in energy consumption.

In view of this, a weft picking system has been proposed to deal with the above energy consumption problem as disclosed, for example, in Japanese Patent Provisional Publication No. 57-199841. In this proposition, a weft traction device including a pair of rotating rollers are used, in which the rollers are contactable and separable so that a weft yarn is held between and drawn by the rollers particularly during the initial stage of a weft picking period at which time pressurized air consumption in a fluid jet nozzle is particularly high. Such a weft traction device functions to positively feed out the weft yarn under the action of the rollers driven at a high speed, and therefore the fluid jet nozzle such as a weft inserting or weft posture regulating nozzle is required merely to regulate the posture of the weft yarn to be projected into the shed of warp yarns, thereby saving air consumption and therefore energy consumption.

Thus, although the above-discussed conventional weft picking system is considerably effective from the view point of reducing energy consumption because the fluid jet nozzle is used only for regulating the posture of the weft yarn to be picked by virue of the direct traction of the rollers, drawbacks have been encountered in the conventional weft picking system as discussed below.

The weft traction device including the rollers are arranged to draw and push the weft yarn by the rollers (between which the weft yarn is put) rotating at a high speed during the weft picking period. Accordingly at the initial stage of the weft picking, a tractive force or speed (to the weft yarn) of the rollers is higher than that of a weft picking nozzle or weft posture regulating nozzle. Owing to this difference in tractive force (speed), a slackened portion of the weft yarn is unavoidably formed between the weft traction device and the weft posture regulating nozzle, and supplied to the weft posture regulating nozzle. In case that the inlet of the weft posture regulating nozzle is clogged with the weft yarn slackened portion, weft picking has failed. In case that the weft yarn slackened portion passes through the weft posture regulating nozzle, the slackened portion is left as it is in a woven cloth thereby forming a weaving defect. Particularly in case of using highly twisted weft yarns, flection of the slackened portion is promoted thereby making an entangled state of the weft yarn. This is left as a defect in the woven fabric thus forming a so-called kink.

Causes of the above weft picking failures and weaving defects will be discussed with reference to FIGS. 34 and 35A to 35C.

In a weft picking, first the weft posture regulating nozzle begins to draw the weft yarn. Subsequently, the rollers of the weft traction device begins to draw the weft yarn. This is illustrated in the graph of FIG. 34 in which the abscissa represents the lapsed time while the ordinate represents the tractive speed (the speed of the drawn weft yarn). A curve a represents the change in tractive speed of the weft posture regulating nozzle while a line b represents the change in tractive speed of the weft traction device.

Detailed explanation will be made on the assumption that a sufficient distance (in length) is set between the weft traction device and the weft posture regulating nozzle. First, the weft posture regulating nozzle begins to eject air jet at a time t1, and then draw the weft yarn, gradually increasing its tractive speed. Subsequently, the rollers of the weft traction device begin to draw or push the weft yarn at a time t2. The traction speed of the weft traction device is momentarily raised in a state in which the weft yarn is kept between the rollers rotating at a constant high speed at which the tractive speed is higher than that of the weft posture regulating nozzle. Accordingly, until the tractive speed of the weft posture regulating nozzle reaches that of the weft traction device, the weft yarn slackened portion is being formed and increases speed. Thereafter, when the tractive speeds of the weft traction device and the weft posture regulating nozzle become the same level at a time t3, an increase of the weft yarn slackened portion stops, and then the slackened portion is gradually diminished as the tractive speed of the weft posture regulating nozzle becomes greater than that of the weft traction device. As discussed above, in case that the weft posture regulating nozzle is sufficiently spaced from the weft traction device, the weft yarn slackened portion is diminished and disappears before reaching the weft posture regulating nozzle, thus preventing the slackened portion from being introduced into the weft posture regulating nozzle.

However, it is to be noted that such a sufficient distance cannot be set between the weft traction device and the weft posture regulating nozzle in practice from the view point of rendering the whole loom compact. Consequently, in such a situation, the weft yarn slackened portion unavoidably reaches the weft posture regulating nozzle before the slackened portion disappears, thereby causing the problems of weft picking failure and weaving defects. The weft yarn slackened portion usually takes a form of FIGS. 35A, 35B or 35C and continuously extends along the moving direction of the weft yarn between the weft traction device and the weft posture regulating nozzle. The form of the weft yarn slackened portion changes depending on weft picking condition and/or kinds of a weft yarn used.

In addition to the above proposition in Japanese Patent Provisional Publication No. 57-199841, another proposition of a weft picking system is made to save air consumption as disclosed in Japanese Patent Provisional Publication No. 4-136237. In this proposition, a weft traction device includes rotatable rollers between a weft measuring and storing device and a fluid jet nozzle, and a weft yarn is kept between the rollers to be drawn and pushed toward the fluid jet nozzle as in the above-discussed proposition. The rotation of the rollers is controlled in timed relation to a loom main shaft by a servo motor, wherein the rollers rotate at a low speed to receive the weft yarn therebetween at the initial stage of the weft picking; the rollers rotate at a high speed to cause the weft yarn to fly at a high speed at the middle stage of the weft picking; and again the rollers rotate at the low speed to release the weft yarn at the terminal stage of the weft picking. Thus, this proposition is intended to prevent a slackened portion of the weft yarn from being formed, by suitably controlling the tractive speed or rotation speed of the rollers of the weft traction device.

However, the weft picking system of this proposition requires a precise rotational control of the rollers by using the servo motor and therefore is difficult to be put into practical use. More specifically, it is generally impossible to make such a follow-up control as to make a considerable change in rotation of the rollers for a very short time for each weft picking particularly when the rotation speed of the loom main shaft is high to meet a high speed loom operation. Even if put into practical use, it requires a very expensive control system which is high in response and control precision and a motor which can momentarily generate a high torque. Thus, the weft picking system of this proposition is difficult to be used in usual looms from a variety of view points.

SUMMARY OF THE INVENTION

An object of the present invention is to provide an improved weft picking system for a fluid jet loom, which can overcome the drawbacks encountered in conventional weft picking systems which includes a roller type weft traction device upstream of a fluid jet nozzle through which a weft yarn is projected into the shed of warp yarns.

Another object of the present invention is to provide an improved weft picking system for a fluid jet loom, which can effectively prevent weft picking failures and/or weaving defects due to formation of a slackened portion of a weft yarn even under a high speed loom operation, without using a complicated and expensive control system.

A further object of the present invention is to provide an improved weft picking system for a fluid jet loom, in which a slackened portion of a weft yarn formed between a weft traction device and a weft posture regulating nozzle is deformed to take a shape to be smoothly introduced into the weft posture regulating nozzle without causing any weft picking failures and/or, weaving defects.

A weft picking system according to the present invention is for a fluid jet loom and comprises a weft measuring and storing device for measuring a predetermined length of a weft yarn and storing it prior to a weft picking. A weft posture regulating nozzle is provided to regulate the posture of the weft yarn fed from the weft measuring and storing device and to be picked into the shed of warp yarns, under influence of fluid jet ejected therefrom. A weft traction device is disposed between the measuring and storing device and the weft posture regulating nozzle and includes a rotatable roller. The weft yarn can be in press contact with the roller to make a traction action of the weft traction device to the weft yarn. The weft yarn from the measuring and storing device is drawn to the weft posture regulating nozzle under the traction action. The roller is always rotating during a weaving operation of the loom. A change-over device is provided and takes a first state to cause the weft yarn to be brought into press contact with the weft traction device roller, and a second state to cause the weft yarn to separate from the weft traction device roller. Additionally, a device is provided to be disposed between the weft posture regulating nozzle and the weft traction device in order to deform a slackened portion of the weft yarn between the weft posture regulating nozzle and the weft traction device. The weft yarn slackened portion is formed due to a difference in temporary tractive speed to the weft yarn between the weft posture regulating nozzle and the weft traction device.

By virtue of the weft yarn slackened portion deforming device disposed between the weft traction device and the weft posture regulating nozzle, the weft yarn slackened portion can be effectively deformed and prevented from being directly introduced into the weft posture regulating nozzle. Accordingly, even though the weft yarn is subjected to or released from the traction action of the weft traction device under a condition in which the roller is always kept rotating at a high speed, no weft picking failure and no weaving defect occur. This provides a loom which is high in productivity. Additionally, it is not required to control the rotation speed of the roller at a high speed for each weft picking, and therefore a control system is simple in construction and low in production cost. It will be appreciated that the term "deforming the slackened portion" means changing the bent state of the slackened portion so as to smoothen the bent state to such an extent as not to bring about any trouble in weft picking and woven fabric in practice.

BRIEF DESCRIPTION OF THE DRAWINGS

In the drawings, like reference numerals designate like elements and parts throughout all the figures, in which:

FIG. 10 is a time chart similar to that of FIG. 9 but showing a control manner of the weft picking system in terms of time, during the period between stopping and re-starting of the loom;

DETAILED DESCRIPTION OF THE INVENTION

Figure 1:
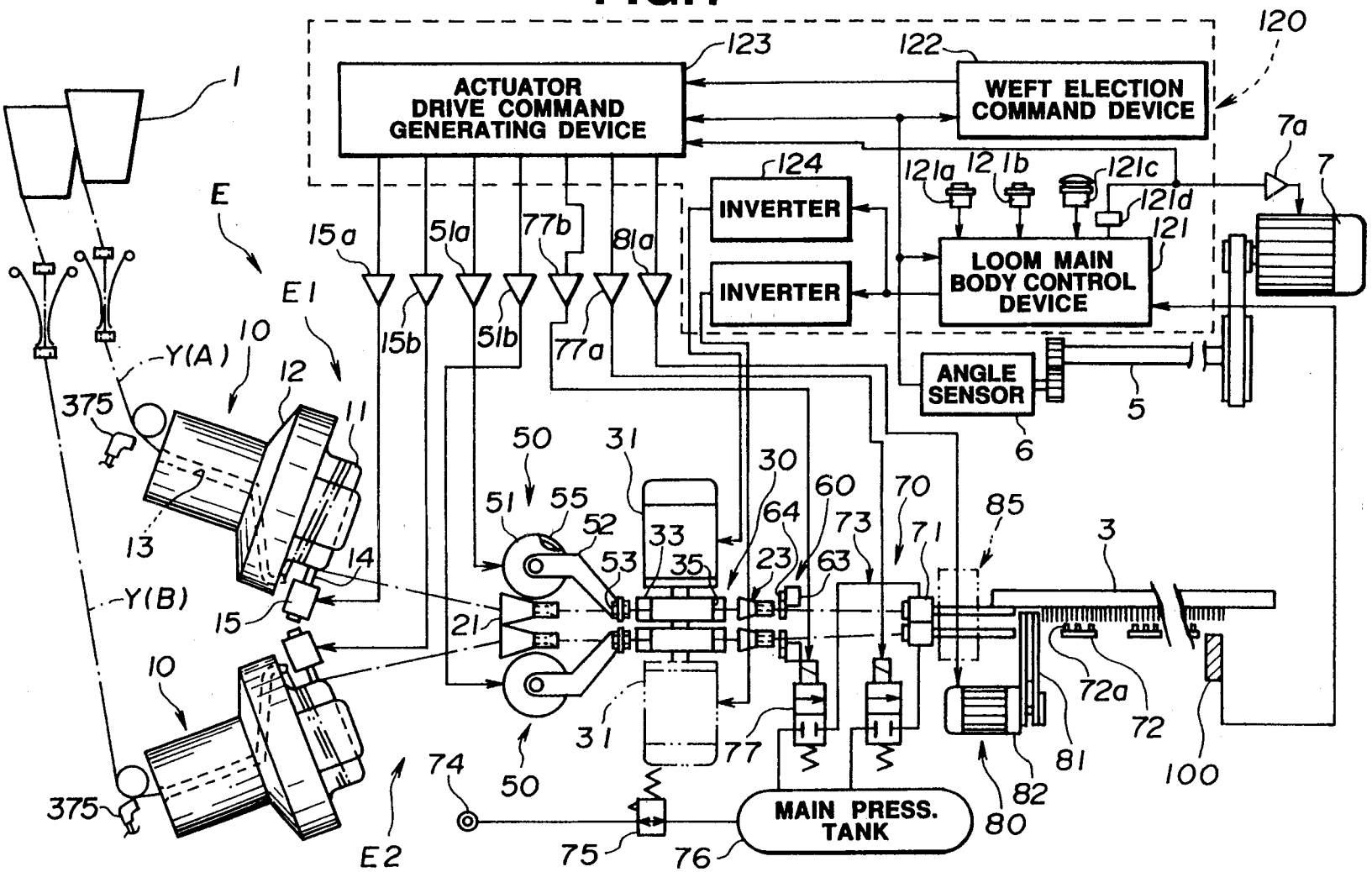
FIG. 1 is a schematic illustration of a first embodiment of a weft picking system in accordance with the present invention, provided with a first example of a weft yarn slackened portion deforming device.

Referring now to FIGS. 1 to 8, more specifically FIG. 1, of the drawings, a first embodiment of a weft picking system according to the present invention is illustrated by the reference numeral E. The weft picking system of this embodiment is for an air jet loom and comprises two weft picking systems E1, E2, one (E1) of which is for a weft yarn Y having color A, and the other E2 being for a weft yarn Y having color B. The color B is different from color A. The two weft picking systems E1, E2 are the same in structure, and therefore explanation will be made only on the weft picking system E1 for the weft yarn having color A.

The weft picking system E1 comprises a weft measuring and storing device 10 for measuring and storing a predetermined length of the weft yarn Y supplied from a yarn supply member 1. The weft yarn Y from the weft measuring and storing device 10 is guided by a yarn guide 21 and fed to a weft traction device 30 which is arranged to draw or drive the weft yarn Y under a weft engaged condition at which the weft yarn Y is put between two rollers 33, 35 of the weft traction device 30. Under a weft disengaged condition at which the weft yarn Y is released from the two rollers 33, 35, the weft yarn Y is not drawn or driven. A change-over device 50 is disposed between the yarn Guide 21 and the weft traction device 30 and arranged to change over the weft yarn Y from the weft engaged condition to the weft disengaged condition, or vice versa. In other words, the change-over device 50 takes an engaging state at which the weft yarn Y is put at the weft engaged condition of the weft traction device 30, and a disengaging state at which the weft yarn Y is put at the weft disengaged condition of the weft traction device 30. The weft yarn Y drawn or driven from the weft traction device 30 passes through a weft yarn slackened portion deforming device 23 and fed to a fluid ejection device 70 which includes a weft posture regulating nozzle 71 for regulating the posture of the weft yarn Y from the braking device 60 under the influence of a jet ejected therefrom. The weft yarn slackened portion yarn guide or deforming device 23 is of a first example and adapted to deform a slackened portion of the weft yarn Y between the weft posture regulating nozzle 71 and the weft traction device 30. The slackened portion of the weft yarn Y is formed due to a difference in temporary tractive force or speed (to the weft yarn Y) between the weft posture regulating nozzle 71 and the weft traction device 30.

A weft braking device 60 is disposed between the yarn guide 23 and the fluid ejection device 70 to be able to provide a running resistance to the weft yarn Y. The fluid ejection device 70 is adapted to cause the weft yarn Y from the weft braking device 60 to fly through the shed of warp yarns (not shown) while regulating the posture of the weft yarn Y under the influence of pressurized air or air jet ejected from it, thereby accomplishing a weft insertion or picking. A cutting device 80 is disposed close to the fluid ejection device 70 to cut the weft yarn Y at a position between a woven cloth (not shown) and the air ejection device 70. A failed-weft yarn removing device 85 is provided to remove a failed weft yarn (Y) under cooperation of the cutting device 80. A weft reaching sensor 100 is disposed at a counter-weft picking side which is opposite to a weft picking side at which the weft posture regulating nozzle 71 is disposed, with respect to the woven cloth. The weft reaching sensor 100 is adapted to detect the reaching of the weft yarn Y flying through the warp shed to the counter-weft picking side. Additionally, a controller 120 is provided to control the operations of the above respective devices. The controller 120 forms part of a microcomputer.

Each of the above respective devices will be discussed in detail also with reference to FIGS. 2 to 8.

The weft measuring and storing device 10 includes a main body 12 having a drum (drum-shaped member) 11. A weft winding arm 13 is rotatably supported by the main body 12 and rotatingly driven by a motor (not shown) disposed inside the main body 12. The weft yarn Y passes through the inside of the weft winding arm 13 and wound by iris predetermined length on the peripheral surface of the drum 11 and stored thereon. The weft yarn Y stored on the drum 11 is engaged with an engaging pin 14 which is inserted into the peripheral surface of the drum 11 and is extended toward the yarn guide 21. The engaging pin 14 is connected to a solenoid 15 and therefore is electromagnetically operated. The engaging pin 14 is adapted to be withdrawn from the periphery of the drum 11 upon energization of the solenoid under electric current supply, thereby disengaging from the weft yarn Y so as to allow the weft yarn Y to unwind from the drum 11. This initiates a weft picking through the warp shed. When the solenoid 15 is deenergized under no electric current supply, the engaging pin 14 is projected or inserted into the periphery of the drum 11 under the action of a spring (not shown) thereby preventing the weft yarn Y from its unwinding from the drum 11. This terminates the weft picking. It will be understood that the solenoid 15 is adapted to be restored to its original state (at which the engaging pin 14 is projected) upon deenergization and therefore is of the self-restoring type. The energization and de-energization of the solenoid 15 are controlled in response to a signal from the controller 120.

Figure 2:
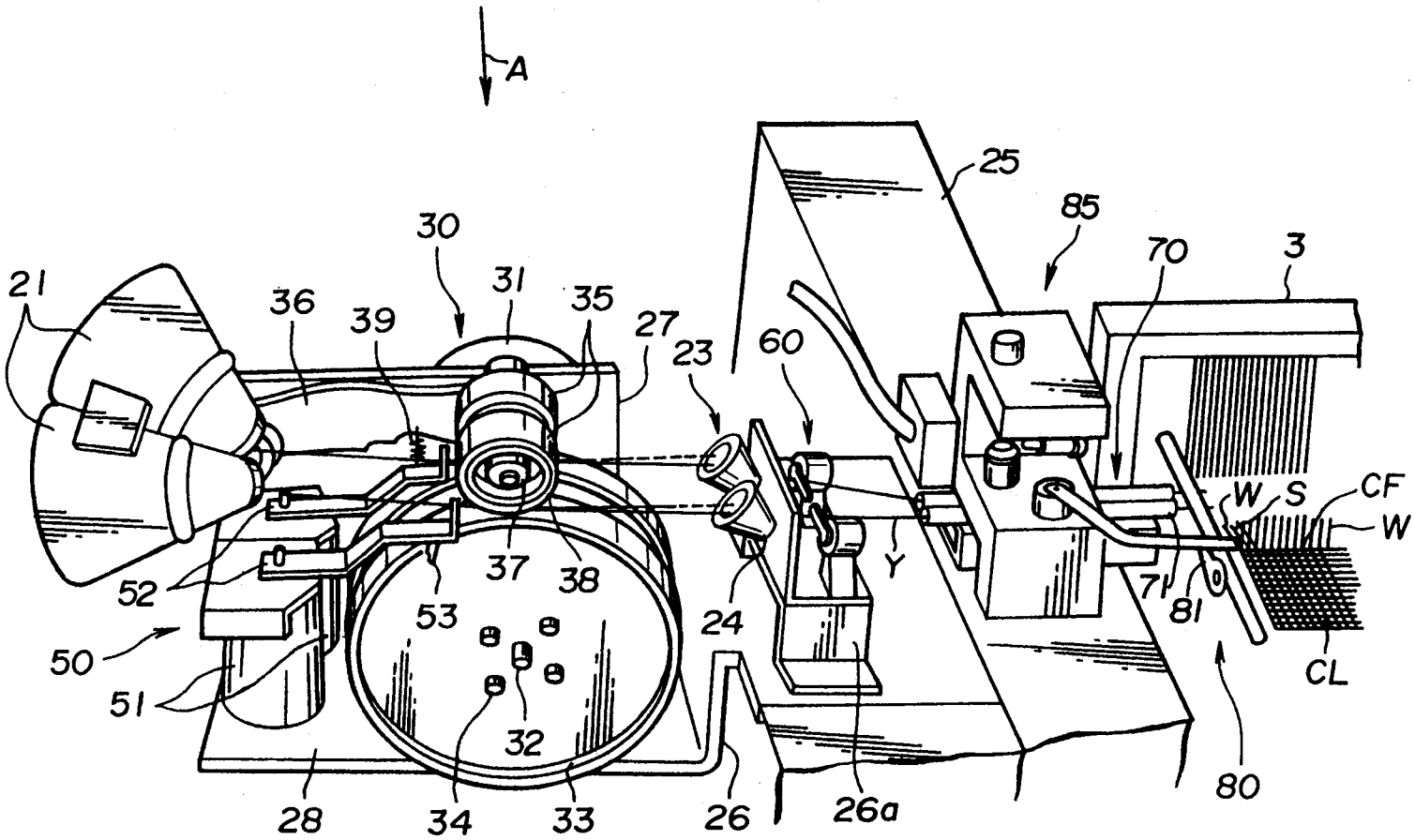
FIG. 2 is a perspective view of an essential part of the weft picking system of FIG. 1.

The yarn guide 21, the change-over device 50, the weft traction device 30, the weft yarn slackened portion deforming device 23, and the weft braking device 60 are installed on a stationary base 26 which extends laterally and outwardly from a side frame 25 of the loom as shown in FIG. 2.

The yarn guides 21 is formed generally pipe-shaped and has an upstream (relative to moving direction of the weft yarn) inner diameter which is larger than its downstream inner diameter, so that the inner diameter gradually decreases in a direction from the upstream side to the downstream side. Thus, the yarn guide 21 functions to guide the weft yarn Y to a predetermined position at the device located downstream thereof with respect to the weft yarn moving direction.

The weft traction device 30 is installed on the stationary base 26 as shown in FIG. 2 and discussed above. More specifically, as shown in FIG. 2, a motor 31 for the weft traction device 30 is installed to a vertical wall 27 of the stationary base 26 and has a power output shaft (not shown) to which a driving shaft 32 is connected. The driving shaft 32 projects generally parallel with the side frame 25 as shown in FIG. 2. Two large diameter rollers 33 made of metal are fixedly and coaxially mounted on the driving shaft 32. The two rollers 33 have respective cylindrical peripheral sections (no numeral) which are the same in outer diameter. The two rollers 33 are located at a predetermined distance from each other in the axial direction of the driving shaft 32 and are fixed to the driving shaft 32 through screws 34.

A small diameter roller 35 is disposed on or above each large diameter roller 33 and has an outer diameter smaller than that of the larger diameter roller 33. The small diameter roller 35 includes an inner roller member 37 which is made of metal and rotatably installed to a free end section of an arm 36. The arm 36 is vertically and movably installed at its base end to the vertical wall 27. A rubber or elastomeric layer 38 is formed at the outer peripheral surface of the inner roller member 37. The small diameter roller 35 is biased against the outer peripheral surface of the large diameter roller 33 under the action of a tension spring 39 extended between the vertical wall 27 and the arm 36. Accordingly, the weft yarn Y is put and held between the rotating large and small diameter rollers 33, 35 and drawn forward under the weft engaged condition. Under the weft disengaged condition, the weft yarn Y is released from the position between the rotating rollers 33, 35, so that no traction force is applied to the weft yarn Y.

Figure 3:
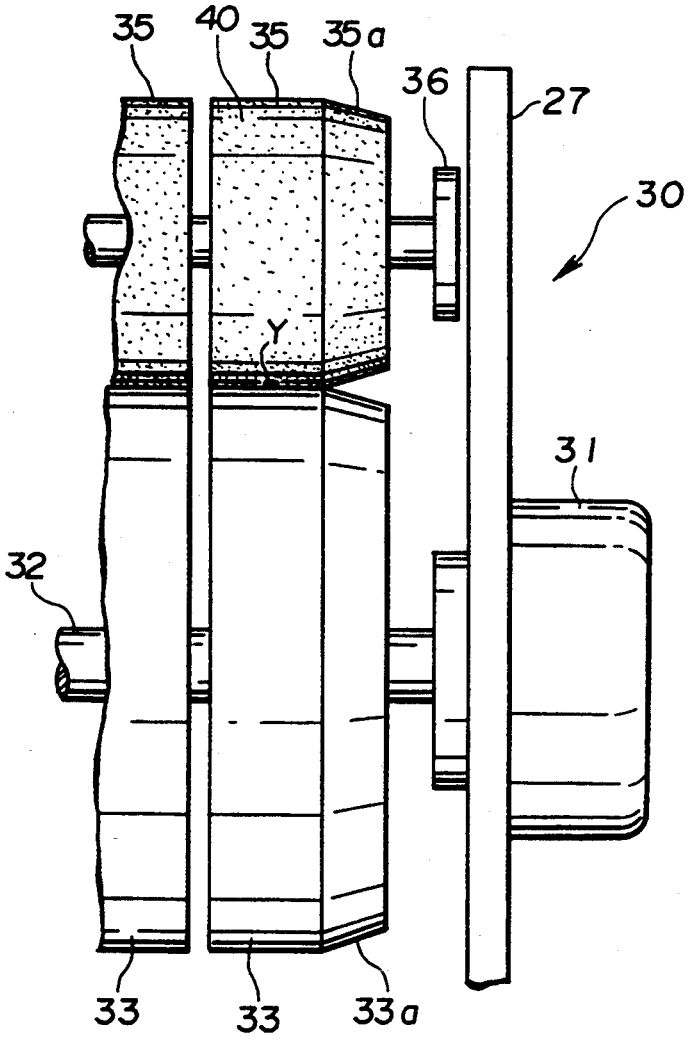
FIG. 3 is a fragmentary enlarged side view of a weft traction device forming part of the weft picking system of FIG. 1.
Figure 4:
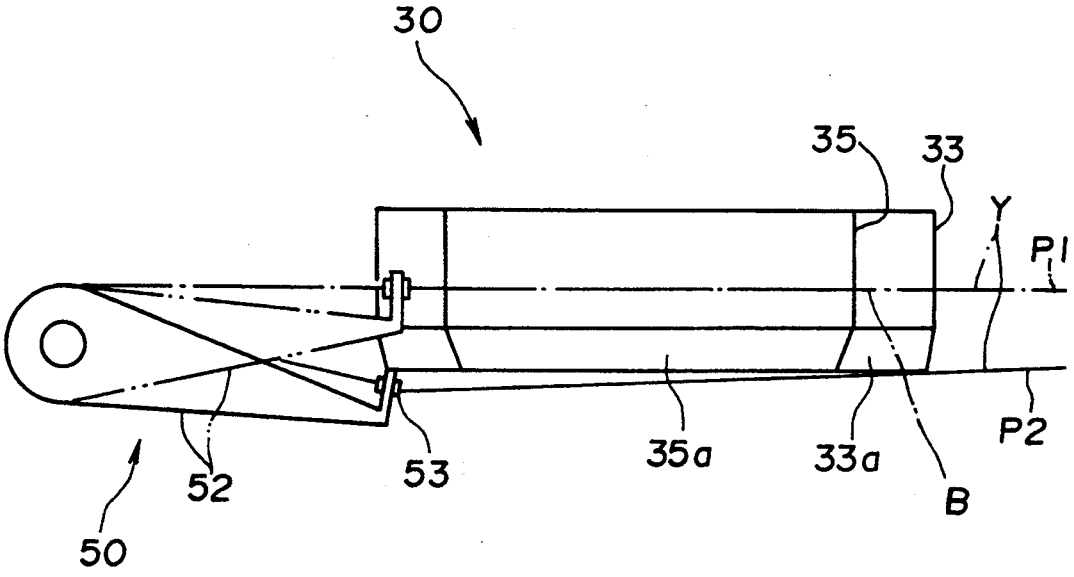
FIG. 4 is a fragmentary enlarged plan view of the traction device as viewed from a direction indicated by an arrow A in FIG. 2.

FIG. 3 shows a state in which the weft yarn Y is put between the rollers 33, 35 so that the traction force of the roller 33 is transmitted to the weft yarn Y. In this state, the peripheral surface of the small diameter roller 35 is in press contact with that of the large diameter roller 33, in which the driving force of the large diameter roller 33 driven by the motor 31 is transmitted to the small diameter roller 35 so that the rollers 33, 35 rotate at the same peripheral speed and in reverse directions relative to each other. The rubber layer 38 of the small diameter roller 35 is in contact with the weft yarn and therefore formed of a soft rubber or elastomeric material such as polyurethane rubber in order to increase the frictional force of the roller 35 relative to the weft yarn Y. It is to be noted that the peripheral surface of each roller 33, 35 is tapered or formed frustoconical at one end section **33*a*, 35*a* through which the weft yarn Y is displaced into or out of the position between the peripheral surfaces of the large and small diameter rollers 33, 35 under the action of the change-over device 50, as shown in FIGS. 3 and 4. It will be understood that the thus formed tapered peripheral surface end section 33*a*, 35*a* facilitates the weft yarn displacement action into or out of the position between the facing rollers 33, 35**.

While the two large diameter rollers 33 have been shown and described as being rotatingly driven by the single motor 31, it will be appreciated that they may be rotatingly driven respectively by two separate motors. The facing rollers 33, 35 may be rotatingly driven respectively by separate driving sources. The two large diameter rollers 33 may have outer diameters different from each other, and the small diameter rollers 35 may have outer diameters different from each other.

The change-over device 50 includes a rotary solenoid 51 having a power output shaft (no numeral). The rotary solenoid 51 is adapted to be energized under supply of electric current, thereby rotatingly driving the power output shaft in one direction. Under no electric current supply to the rotary solenoid 51, the rotary solenoid 51 is deenergized so that the power output shaft is rotated in the reverse direction under the biasing force of a spring 55. Thus, the rotary solenoid 51 is electromagnetically operated and is of the self-restoring type wherein the power output shaft is returned to its original position under the biasing force of the spring 55. The rotary solenoid 51 is secured on a bottom wall 28 of the stationary base 26. A traverse lever 52 is fixedly mounted on the power output shaft of the rotary solenoid 51, and arranged to rotatingly move around the axis of the power output shaft. The free end section of the traverse lever 52 is movably located near a location at which the large and small diameter rollers 33, 35 are contacted to each other. The free end section of the traverse lever 52 is bent upwardly to form an upwardly extending tip end portion (no numeral) which is formed with a weft yarn insertion hole 53 through which the weft yarn Y is passed.

FIG. 4 shows two operational states of the weft traction device 30, i.e., the weft engaged condition indicated by broken lines and the weft disengaged condition indicated by solid lines. When the traverse lever 52 of the change-over device 50 is being stopped at its original position indicated by the solid lines in FIG. 4 under the self-restoring function of the rotary solenoid 51, the weft yarn Y is on a displaced weft path P2 which is displaced from a normal weft path P1, so that the weft yarn Y gets out of the position between the rollers 33, 35 thereby establishing a no traction condition in which no traction force is applied to the weft yarn Y. When the traverse lever 52 is moved from the original position to its position indicated by the broken lines upon energization of the rotary solenoid 51, the weft yarn Y is returned on the normal weft path P1 so as to be put into the position between the rollers 33, 35 thereby establishing a traction condition in which a traction force is applied to the weft yarn Y. As discussed before, since the tapered peripheral surface end sections 33*a*, 35*a* are formed respectively in the rollers 33, 35, the change-over operation for the weft yarn Y between its disengaged position indicated by the solid lines and its engaged position indicated by the broken lines is facilitated.

The weft yarn slackened portion deforming device 23 will be discussed in detail.

Figure 5:
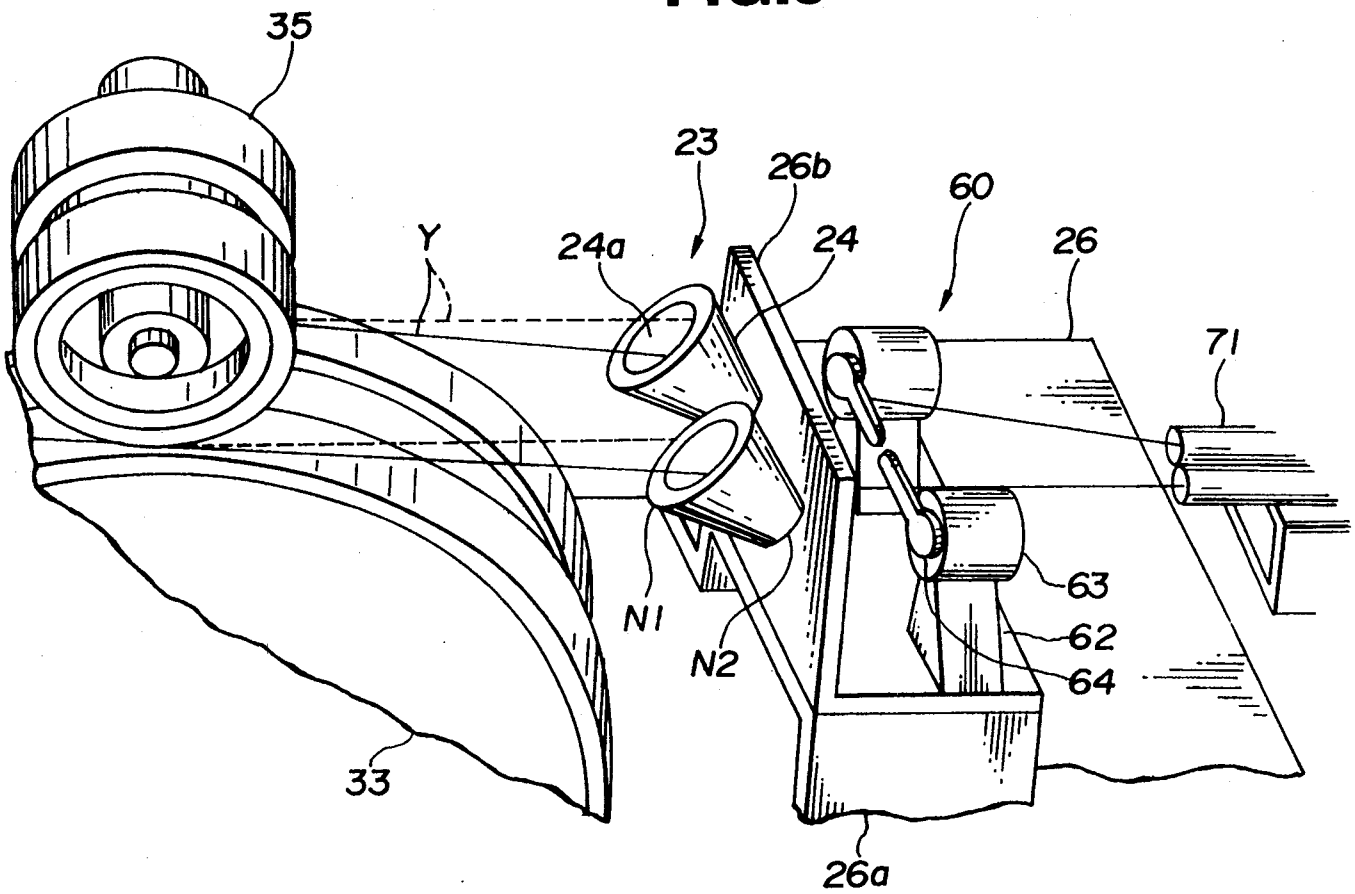
FIG. 5 is a fragmentary enlarged perspective view of a part of the arrangement of FIG. 2.
Figure 6:
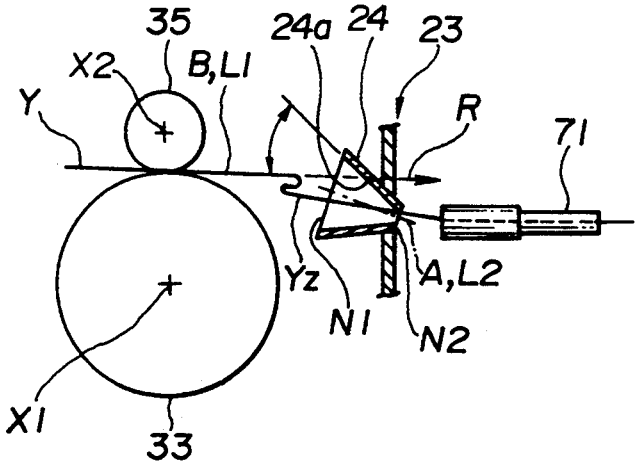
FIG. 6 is an explanatory view for showing an operational function of the essential part of the weft picking system of FIG. 1.

As shown In FIG. 5, the weft yarn slackened portion deforming device 23 includes a weft yarn contacting member 24 of the generally hollow frustoconical shape and therefore serves also as a yarn guide. The weft yarn contacting member 24 is fixedly installed to a vertically standing wall 26*b* forming part of a stand member 26*a* which is fixedly mounted on the stationary base 26. The weft yarn contacting member 24 has front and end portions N1, N2 in which front end portion N1 is larger in diameter than the rear end portion N2. The front end portion N1 faces the rollers 33, 35 while the rear end portion N2 faces the weft posture regulating nozzle 71. As best shown in FIG. 6, the weft yarn contacting member 24 is located in such a manner that the axis A thereof inclines relative to a horizontal plane (not shown) and rises upwardly in the direction toward the rollers 33, 35. In other words, the axis A of the weft yarn contacting member 24 inclines downwardly relative to a direction in which the weft yarn Y moves from the rollers 33, 35 to the weft posture regulating nozzle 71. The weft yarn contacting member 24 is formed thereinside with a generally frustoconical inner surface 24*a* which is formed smooth It will be understood that a slackened portion Yz (in FIG. 6) is formed in the weft yarn Y between the weft traction device 30 and the weft posture regulating nozzle 71 owing to a difference in temporary tractive force or speed (to the weft yarn Y) between the weft traction device 30 and the Weft posture regulating nozzle 71. The slackened portion Yz of the weft yarn Y thrown horizontally or in the direction of an dotted arrow R (in FIG. 6) from the weft traction device 30 is brought into contact with the inner surface 24*a* of the weft yarn contacting member 21 whose axis A is inclined as discussed above. The inner surface 24*a* serves also as a weft yarn storing surface at which the moving weft yarn Y is temporarily stored. As shown in FIG. 6, a suitable acute angle $\theta$ (not shown) is formed between the generally frustoconical inner surface 24*a* of the weft yarn contacting member 21 and the direction indicated by the dotted allow R on an imaginary vertical plane (not shown) containing the axis A of the waft yarn contacting member 21. It will be understood that a suitable slackened portion deforming effect cannot be obtained if the acute angle $\theta$ is too small or so large as to form an obtuse angle.

Additional IV, as clearly shown in FIG. 6, the locational relationship between the weft traction device 30 and the weft yarn contacting member 24 is arranged such that a first imaginary plane L1 is offset from or not aligned with a second imaginary plane L2. The first imaginary plane L1 passes through a surface at which the rollers 33, 35 contact with each other and is perpendicular to an imaginary plane (not shown) passing through the axis X1 of the roller 33 and the axis X2 of the roller 35. The second imaginary plane L2 is parallel with the axes X1, X2 of the rollers 33, 35 and passes through the axis of the weft yarn contacting member 24. The first and second imaginary planes L1, L2 form therebetween an obtuse angle. However, an axis B shown in FIG. 4 and 6 is generally aligned with the axis A of the weft yarn contacting member 24 as viewed from the direction A of FIG. 2 or on the horizontal plane (not shown) parallel with the planes L1, L2. The axis B is contained in the plane L1 and generally aligned with the path of the weft yarn Y between the rollers 30, 33.

Figure 34:
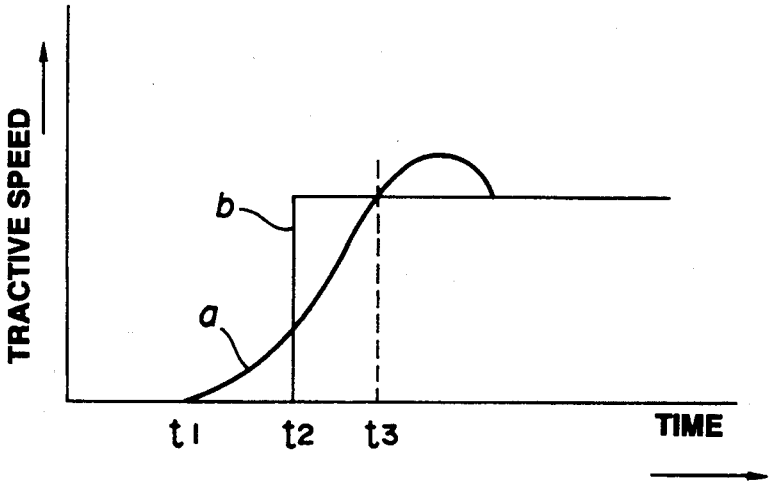
FIG. 34 is a graph illustrating mechanism of formation of the weft yarn slackened portion in a conventional weft picking system including a roller type weft traction device upstream of a fluid jet nozzle.
Figure 35A:
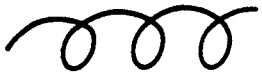
FIGS. 35A to 35C are respectively sketches of a variety of shapes of weft yarn slackened portions in the conventional weft picking system of FIG. 34.
Figure 35B:
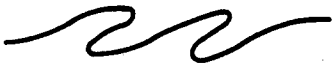
Figure 35C:
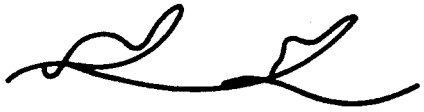

The thus arranged weft yarn contacting member 24 functions as follows: First, the weft yarn Y is drawn by the weft posture regulating nozzle 71 simultaneously with the initiation of a weft picking. Subsequently, the weft yarn Y receives a traction force in the horizontal direction R under the action of the rollers 33, 35 which are rotating at a high speed. Then, the slackened portion Yz is unavoidably formed due to the difference in temporary tractive force or speed (to the weft yarn Y) between the weft posture regulating nozzle 71 and the weft traction device 30 (the rollers 33, 35) and under the same mechanism as discussed in FIG. 34. This slackened portion Yz is curved and extends from the upward side to the downward side in the moving direction of the weft yarn Y in a space between the weft traction device 30 and the weft posture regulating nozzle 71. At this time, the slackened portion Yz moves horizontally toward the weft posture regulating nozzle 71 and is brought into contact with the generally frustoconical inner surface 24*a* of the weft yarn contacting member 24. Upon this contact, the weft yarn slackened portion Yz is changed in its form from a three dimensional and complicated one to a smooth curved one and moves along the weft yarn contacting member inner surface 24*a* in a manner to be stored there. Then, the following portion of the weft yarn Y pushed by the weft traction device 30 is forced to the slackened portion Yz while the preceding portion of the weft yarn Y drawn by the weft posture regulating nozzle 71 is pulled out of the weft yarn contacting member 24 through the opening at the rear end portion N2. At this time, the weft yarn Y is pressed at the peripheral edge of the rear end portion N2 of the weft yarn contacting member 24, so that the slackened portion Yz is deformed and attenuated in its curved form thereby taking a generally straight line form. Thereafter, when the tractive force (speed) of the weft posture regulating nozzle 71 reaches to a level exceeding that of the weft traction device 30, the slackened portion Yz is attenuated and deformed and therefore directly passes through the rear end portion N2 of the weft yarn contacting member 24 to be drawn into the weft posture regulating nozzle 71.

Figure 7:
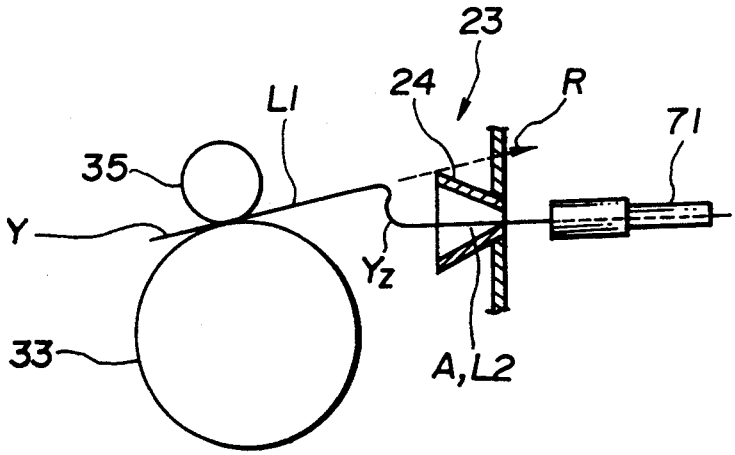
FIG. 7 is an explanatory view similar to FIG. 6 but showing an operational function of the essential part of the first embodiment weft picking picking system provided with a modified example of the weft yarn slackened portion deforming device.

It will be appreciated that the locational relationship between the weft traction device 30 and the weft yarn contacting member 21 may be arranged as shown in FIG. 7. That is, the weft yarn contacting member 21 is located in such a manner that the axis A is horizontal while the weft traction device 30 is arranged such that the direction R is inclined upwardly relative to the axis A on the imaginary vertical plane containing the axis A. It will be understood that the same weft yarn slackened portion defoming effect as in the arrangement shown in FIG. 6 can be obtained by setting the above-mentioned acute angle $\theta$ between the direction R and the inner surface 24*a* of the weft yarn contacting member 24.

The weft braking device 60 is disposed on the downstream side of the weft yarn slackened portion deforming device 23 with respect to the weft yarn running direction and located close to the weft yarn slackened portion deforming device 23. The weft braking device 60 includes a bracket 62 fixedly mounted on the stand member 26*a*. A rotary solenoid 63 (serving as a brake solenoid) of the electromagnetically operated and self-restoring type (like the rotary solenoid 51) is installed on the bracket 62 and has a power output shaft (not shown) on which a rod-like operating arm is fixedly mounted and located near the weft yarn slackened portion deforming device 23.

Figure 8:
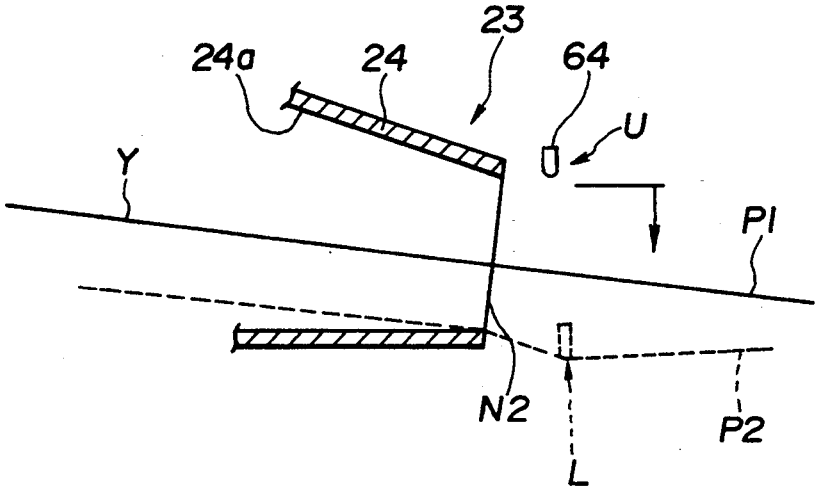
FIG. 8 is an explanatory view for illustrating the function of a weft braking device in the weft picking system of FIG. 1.

When the rotary solenoid 63 is not being energized upon receiving no signal from the controller 120, it rotationally biases operating arm 64 downwardly under the bias of a spring (not shown) or under the self-restoring function so that the operating arm 64 displaces from its upper position U to its lower position L as shown in FIG. 8. Accordingly, the weft yarn Y is pressed downwardly to take the displaced path P2, in which the weft yarn Y is brought into press contact with the inner peripheral edge at the rear end portion E2 of the weft yarn contacting member 24. As a result, a running resistance is applied to the weft yarn Y. When the rotary solenoid 63 is energized upon receiving the signal from the controller 120, the operating arm 64 is rotatingly forced upwardly to be displaced from the lower position L to the upper position U in FIG. 8, so that the operating arm 64 becomes separate from the weft yarn Y. At this time, the weft yarn Y is displaced from the displaced path P2 to the normal path P1. It will be understood that the weft braking device 60 may be located on an upstream side of the weft yarn slackened portion deforming device 23 with respect to the weft yarn running direction.

The weft posture regulating nozzle 71 which forms part of the fluid ejection device 70 is supplied with pressurized air from a pressurized air supply line 73. The pressurized air supply line 73 includes a main pressure tank 76 which is connected through a pressure reducing valve 75 to a pressurized air supply source 74. The air-out let side of the main pressure tank 76 is connected to the weft posture regulating nozzle 71 via an electromagnetically operated valve 77 of the self-restoring type wherein the valve takes an original state when a solenoid (not shown) is deenergized. Thee valve 77 is adapted to open or close in response to a signal from the controller 120, thereby allowing the weft posture regulating nozzle 71 to make or stop ejection of air jet. Under this air jet ejection, the weft yarn drawn from the weft traction device 30 and threaded in the weft posture regulating nozzle 70 is regulated in posture and picked into the shed S of warp yarns W so as to fly toward the counter-weft picking side.

A plurality of sub-nozzle groups 72 are mounted on a reed 3 of the loom and located on the side of the cloth fell CF of the woven cloth CL. The sub-nozzle groups 72 are arranged along the shed S of the warp yarns W. Each sub-nozzle group 72 includes a plurality of sub-nozzles 72*a*, five sub-nozzle groups in this embodiment. Each sub-nozzle group includes three sub-nozzles 72*a* as shown in FIG. 1. The sub-nozzles 72*a* of the respective sub-nozzle groups 72 are supplied with pressurized air from a pressurized air supply line (not shown) which includes a relief valve (not shown) connected to the pressurized air supply source 74. The relief valve is connected to a constant pressure tank (not shown) which is connected to a plurality of the electromagnetically operated and self-restoring type valves (not shown but similar in construction to the valve 77) which are respectively connected to the sub-nozzle groups 72. The plural valves corresponding to the respective sub-nozzle groups 72 are successively opened in a direction from the weft picking side to the counter-weft picking side in response to respective signals output from the controller 120, in which each valve is opened during a predetermined time (valve opening time). This allows the respective sub-nozzle groups 72 to make relay-ejection of pressurized air in a manner to follow the tip end section of the weft yarn Y projected from the weft posture regulating nozzle 71. By virtue of such relay-ejection of pressurized air, the weft yarn Y flies through an air guide passage (not shown) formed in the reed 3 and located inside the warp shed, and reaches the counter-weft picking side thereby accomplishing the weft picking or insertion.

The cutting device 80 functions to cut the weft yarn Y beaten-up by the reed 3, and includes a cutter 81 which is fixedly secured near the side of the cloth fell of the woven cloth so as to extend in a fore-and-aft direction of the loom. The cutter 81 has upper and lower blades (no numerals). The lower blade of the cutter 81 is driven by a rotary solenoid 82 so as to make a cutting action for the weft yarn Y under incorporation of the upper blade.

The failed-weft yarn removing device 85 is for automatically removing the weft yarn Y failed in weft picking (such as a mispicked weft yarn). The removing device 85 is disposed on the side flame 25 and located near the cloth fell of the woven cloth. A detailed explanation of the removing device 85 is omitted for the simplicity of illustration because the removing device 85 has no direct relation to the essence of the present invention.

The weft reaching sensor 100 is disposed on the counter-weft picking side with respect to a warp array (not shown) or the woven cloth, in order to detect a weft reaching timing at which the picked weft yarn has reached to the counter-weft picking side. The weft reaching sensor 100 outputs a signal representative of the weft reaching timing. An angle sensor 6 is provided to detect rotational angle positions of a main shaft 5 of the loom, and to output signals representative of the respective rotational angle positions. The output signals from the weft reaching sensor 100 and from the angle sensor 6 are fed to the controller 120.

In connection with these output signals, the controller 120 carries out the following control. First, the detected weft reaching timing which represents the time at which the signal from the weft reaching sensor 6 has been input to the controller 120 is set as the rotational angle position detected by the angle sensor 6. A calculation is made to determine a difference between the detected weft reaching timing set the rotational angle position and a set weft reaching timing which has been previously preset as a standard value in the controller 120. With this difference, the moving or swinging timing (a traverse timing) of the traverse lever 52 of the change-over device 50 is corrected. This corrected swinging timing which is set as a correction command is fed back to a set swinging timing (of the traverse lever 52) which has been determined in accordance with a revolution speed of the loom and a width of the cloth to be woven. The revolution speed and the cloth width is input to the controller 120 by an operator during a preparation operation for a loom weaving operation. At this time, an electric current supply time (time duration), supplied from electric power source (not shown) to the rotary solenoid 51, is controlled to regulate a time for which the traverse lever 52 of the change-over device 50 is stopped at its weft engaging position for causing the weft yarn Y to be engaged with the rollers 33, 35 of the weft traction device 30.

The controller 120 includes a loom main body control device 121 which is electrically connected to a weft selection command device 122 and to an actuator drive command generating device 123. Thus, the devices 121, 122, 123 are mutually electrically connected with each other, in which the signal from the angle sensor 6 incorporated with the loom main shaft 5 is directly fed to the devices 121, 122, 123. Accordingly, the devices 121, 122, 123 operate independently in response to the signals from the angle sensor 6. The controller 120 further includes inverters 124 electrically connected to the loom main body control device 121.

The loom main body control device 121 includes a control section, a calculation section, a memory section, and an input section by which set values are manually input by an operator (not shown). The loom main body control device 121 is electrically connected to a host computer (not shown) for controllably managing a plurality of looms (not shown). The loom main body control device 121 is constructed and arranged to generate loom operation signals to control the starting and stopping of a loom main motor 7 (for driving the loom main shaft 5) and each inverter 124 for the motor 31 of the weft traction device 30. The operation of the loom main body control device 121 will be discussed in detail with reference to a time chart after.

The loom main body control device 121 is provided with a ready button **121*a*, a start button 121*b*, and a stop button 121*c*. The ready button 121*a* is pushed to begin operation of the loom, at which time, for example, a command is made to start the inverter 124 of the motor 31 which reaches a normal operational speed for normally operating the weft traction device 30, and to start the operation of a timer 121*d* connected between the control section of the loom main body control device 121 and the a driver 7*a* of the main motor 7. The start button 121*b* is pushed after the motor 31 has been reached the normal rotational speed and after a signal representative of completion of preparation for loom operation starting has been output. Upon pushing this start button 121*b*, the loom main motor 7 is started. It is to be noted that when the start button 121*b* is pushed before the motor 31 has not reached the normal rotational speed, the loom operation cannot start under the action of the timer 121*d* and instead starts after lapse of a predetermined time since the pushing of the start button 121*b*. The stop button 121*c*** is pushed to stop the loom operation and can be pushed at any time if required.

The timer **121*d* is in a state of being closed to allow electric current flow at a set time 0 (zero) and in a state of being opened to stop electric current flow during a set time period or during the predetermined time. When the ready button 121*a* is pushed, the control section of the loom main body control device 121 makes a command to start the motor 31, and simultaneously starts the operation of the timer 121*d* in which the predetermined time has been previously set. Upon lapse of the predetermined time, the timer 121*d* is put into the state of being closed. Then, by pushing the start button 121*b*, a starting signal is input from the control section to the driver 7*a* thereby to start the main motor 7 and to start the loom operation. Simultaneously, an operation signal is output to the weft election command device 122 and to the actuator drive command generating device 123 thereby placing the devices 122, 123 in an operative condition. The above-mentioned predetermined time is a time duration during which the rotational speed of the roller 33** reaches an optimum level (the normal operational speed) for accomplishing a weft picking, for example, within a range of from 10 seconds to 30 seconds.

The weft selection command device 122 is arranged to command the actuator drive command generating device 123 to select the weft yarn Y which is to be used in the next weft picking cycle, in accordance with an order previously programmed. In the case of multiple color weaving, a plurality of weft yarns having different colors are used. The multiple color weaving includes a so-called one-one pattern weaving, and a so-called one-two pattern weaving. In the one-one pattern weaving, two kinds of weft yarns are alternately picked. In the one-two pattern weaving, two weft yarns of a first kind are picked after one weft yarn of a second kind is picked. It will be understood that one weft yarn is picked in one weft picking cycle. In this embodiment in which one of the weft yarns Y is of color A and the other of color B, the weft selection command device 122, for example, designates to the actuator drive command generating device 123 that the weft yarn Y having color A is to be used at the next weft picking cycle. A signal representative of this designation has already been output at a main shaft rotational angle of about 300 degrees in the precedent weft picking cycle. Then, when the rotational angle has reached 300 degrees in the present weft picking cycle, for example, a signal representative of an designation or selection of the weft yarn Y having color B as the weft yarn Y to be used in the next weft picking cycle is output. There are a variety of orders of the weft yarns having colors A and B such as A-B-B . . . or A-A-B-A-A-B . . . . It will be understood that the above-mentioned precedent output of the designation is made for the purpose of preventing malfunctions due to a response delay of each actuator after the selection of the weft yarn have been made.

The actuator drive command generating device 123 is arranged to successively operate the respective actuators through drivers (not shown). The actuators include an actuator 15*a* for operating the engaging pin 14 of the weft measuring and storing device 10 in the weft picking system E1, and an actuator 15*b* for operating the engaging pin 14 of the weft measuring and storing device 10 in the weft picking system E2. The actuators further include an actuator 51*a* for operating the traverse lever 52 of the change-over device 50 in the weft picking system E1, an actuator 51*b* for operating the traverse lever 52 of the change-over device 50 in the weft picking system E2, an actuator 77*a* for operating the valve 77 in the weft picking system E1, an actuator 77*b* for operating the valve 77 in the weft picking system E2, and an actuator 82*a* for operating the cutter 81 of the cutting device 80. In the case of multiple color weaving, the above actuators are selectively operated in accordance with the previously input programmed order of designation or selection of the respective plural weft yarns Y having different colors.

Figure 9:
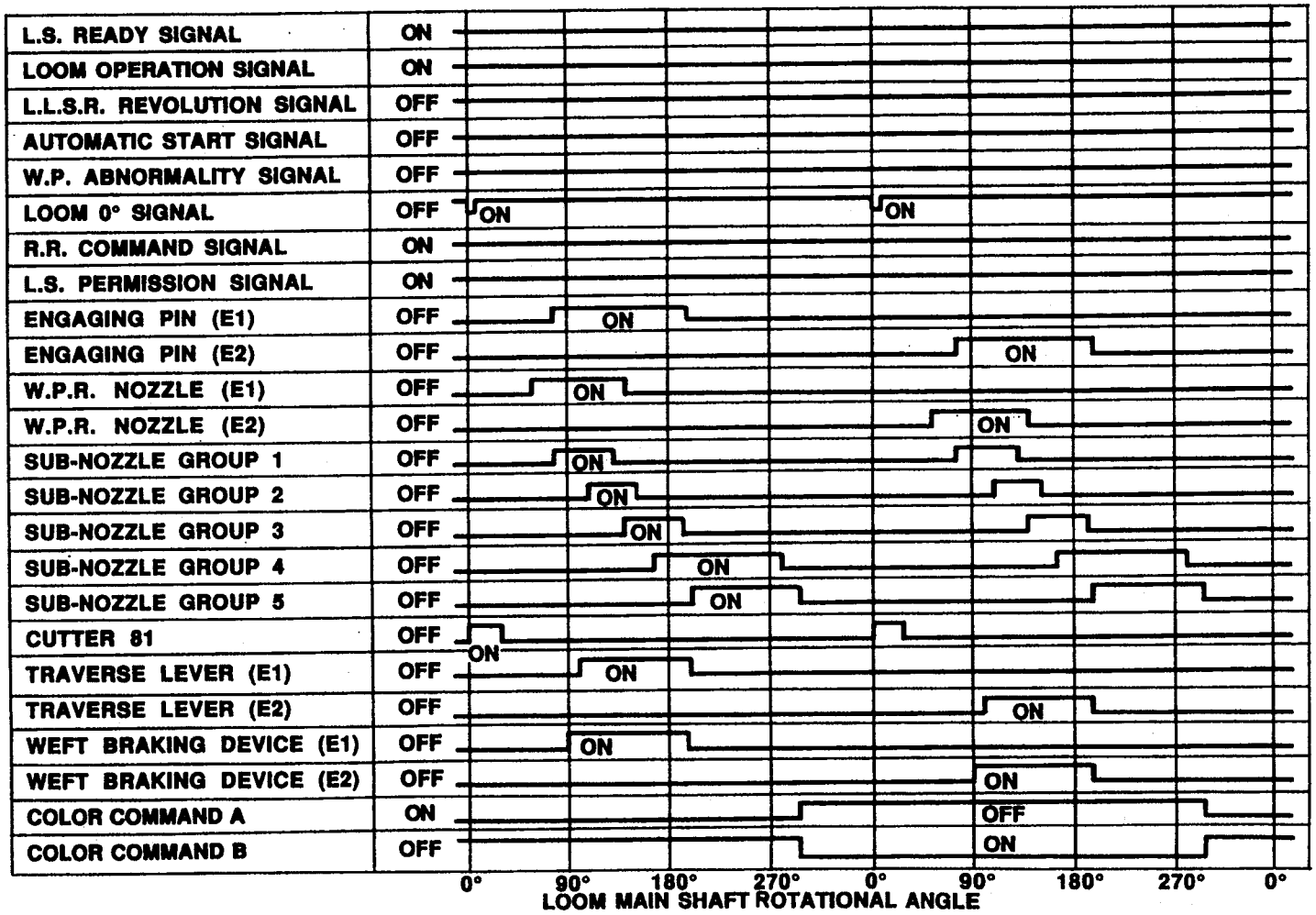
FIG. 9 is a time chart showing a control manner of the weft picking system of FIG. 1 in terms of a loom main shaft rotational angle, during a normal operation of the loom.

Next, the manner of operation of the weft picking system E of the present invention will be discussed with reference to the time chart in FIG. 9. The time chart shows operational states of the respective actuators in the case where the loom provided with the weft picking system E makes its steady state operation. The operations of the actuators for the devices and items (listed at the left-most column) are illustrated in terms of the loom main shaft rotational angle. Although this time chart illustrates the case of the one-one pattern weaving in which the weft yarns Y in the weft picking systems E1, E2 are alternately picked, the operations of the respective weft picking systems are fundamentally the same and therefore explanation will be made only on the weft picking system E1.

The devices and items listed at the left-most column in the time chart of FIG. 9 will be explained. A loom starting (L.S.) ready signal takes its ON state when the ready button 121*a* is pushed, thereby to make preparation of a weaving operation so as to make use of the electric power supply. When the loom ready signal takes its OFF state, the electric power supply is cut. Additionally, when the loom starting ready signal takes the ON state, a roller rotation (R.R.) command signal takes its ON state at which a command for starting the rotation of roller 33 is generated. When the roller rotation command signal takes its OFF state, the command is not generated. A loom operation signal takes its ON state when the start button 121*b* is pushed after a loom starting (L.S.) permission signal is changed to its ON state for permitting starting of the main motor 7. The loom starting permission signal takes the ON state when the rotational speed of the roller 33 has reached a predetermined level at which the weft traction device 30 normally functions. The loom operational signal takes its OFF state when the start button 121*b* is not pushed. The loom starting permission signal takes its OFF state for preventing the permission of starting of the main motor 7. A loom low speed reverse revolution (L.L.S.R.) signal takes its ON state for reversely rotating the loom main shaft 5 at a low speed, and its OFF state at which the reverse rotation of the loom main shaft 5 is not made. An automatic start signal takes its ON state at which the loom is automatically started, and its OFF state at which no automatic start of the loom is made. A weft picking (W.P.) abnormality signal takes iris ON state when an abnormality (failure) in weft picking (such as mispick or short pick) is detected. The weft picking abnormality signal takes its OFF state when no abnormality in weft picking is detected. A loom 0 degree signal takes its ON state when the rotational angle of the loom main shaft 5 is at 0 degree. The loom 0 degree signal takes its OFF state when the loom main shaft rotational angle is out of 0 degree. The "engaging pins (E1), (E2)" indicate respectively those 14 in the weft picking systems E1 and E2. Each engaging pin 14 takes its ON state to be projected to the drum 11 so that the weft yarn Y is engaged with the engaging pin, and its OFF state to be withdrawn from the drum 11 so that the weft yarn Y is disengaged from the engaging pin. The "weft posture regulating nozzles (E1), (E2)" indicate respectively those 71 in the weft picking systems E1, E2. The "sub-nozzle groups 1, 2, 3, 4, 5" indicate respectively groups 72 of the sub-nozzles 72*a* which groups are arranged in the mentioned order in a direction from the weft picking side to the counter-weft picking side. Each nozzle takes its ON state to eject air jet, and its OFF state at which no air jet ejection is made. The "traverse levers (E1), (E2)" indicate respectively those 52 in the weft picking systems E1, E2. Each traverse lever 52 takes its ON state at which the weft yarn Y receives the traction force or action of the weft traction device 30, and its OFF state at which the weft yarn Y is released from the traction action of the weft traction device 30. The "weft braking devices (E1), (E2)" indicates respectively those 60 in the weft picking systems E1, E2. Each weft braking device 60 takes its OFF state for applying its braking act ion to the weft yarn Y, and its ON state for releasing the weft yarn Y from the braking action. Color commands A, B represent respectively generations of commands for selecting the weft yarns having colors A and B. Accordingly, the command corresponds to the signal representative of the designation of the weft yarn having color A or B. When the color command takes its ON state, the weft yarn having the corresponding color is selected. No such selection is made at its OFF state.

At a timing immediately before the main shaft rotational angle reaches 0 degree at which the beating-up operation is made by the reed 3, the tip end section of the weft-yarn Y has reached the counter-weft picking side. At this time, the weft yarn Y is being engaged with the engaging pin 14 so as not to be picked, in which the weft posture regulating nozzle 71 has not yet ejected air jet. The rollers 33, 35 of the weft traction device 30 are rotating; however, the weft yarn Y is on the displaced path P2 (See FIG. 4) and therefore released from the traction action of the weft traction device 30, i.e., the weft yarn is in the no traction condition. The braking device 60 is operated to apply the braking action to the weft yarn Y. At a timing at which the loom main shaft rotational angle has exceeded 0 degree, the cutting device 80 operates to cut the weft yarn Y.

When the loom main shaft rotational angle has reached 60 degrees, the weft posture regulating nozzle 71 starts ejection of air jet; however, the weft yarn Y cannot fly or be projected from the weft posture regulating nozzle 71. Subsequently, the engaging pin 14 is withdrawn from the drum 11, and therefore the weft yarn Y is projected from the weft posture regulating nozzle 71 to start its flight. Immediately after this, the braking device 60 is released so that the weft yarn Y is released from the braking action of the weft braking device 60. Simultaneously, the traverse lever 52 of the change-over device 50 is operated to form the normal path P1 (See FIG. 4) on which the weft yarn Y is brought into the position between the rollers 33, 35. Accordingly, the weft yarn Y receives the traction force from the rollers 33, 35 and therefore drawn at a predetermined high speed toward the counter-weft picking side, thus putting the weft yarn in the traction condition. Then, the weft yarn Y makes its flight toward the counter-weft picking side upon being regulated in posture. The flight of the weft yarn Y is made through the air guide channel formed in the reed 3 upon being supported by air jets ejected from the sub-nozzles 72*a* arranged along the air guide channel. When a unwinding sensor (not shown) disposed near the engaging pin 14 detects a predetermined number of unwound turn of the weft yarn Y wound on the drum 11, the engaging pin 14 is immediately projected to the drum 11 so as to be brought into its engagement position at which the weft yarn is engaged with the engaging pin 14 to be stopped in flight toward the counter-weft picking side. When about one turn of winding of the weft yarn Y has been made after the time of the engaging pin 14 is brought into its engagement position, the weft yarn Y is substantially engaged with the engaging pin 14 thereby terminating the weft picking.

Before the weft yarn Y is actually brought into engagement with the engaging pin 14, the traverse lever 52 changes the path of the weft yarn Y from the normal path P1 (in the traction condition) to the displaced path P2 (in the no traction condition) thereby releasing the weft yarn Y from the traction action of the weft traction device 30. Simultaneously, the weft braking device 60 comes to its operating condition to apply the braking action to the weft yarn Y. As a matter of fact, a peak tension is applied to the weft yarn Y when the weft yarn Y is actually brought into engagement with the engaging pin 14; however, the peak tension is suppressed to a considerably lower value under the braking action of the braking device 60 which is optimally adjusted to obtain an optimum braking force to the predetermined flight speed of the weft yarn Y. The reaching of the weft yarn Y to the counter-weft picking side is detected by the weft reaching sensor 100, and a detection signal representative of the weft reaching is input to the controller 120.

Subsequently, the operational states of the loom provided with the weft picking system E will be discussed with reference to a time chart of FIG. 10 in which operations of the actuators for the devices and items (listed at the left-most column) are illustrated in terms of time during a period from a stop and a start of the loom.

First, the ready button 121*a* for starting the loom is pushed so that the loom starting ready signal is changed to its ON state from its OFF state. The time at which the ready button 121*a* is pushed is assumed to be t1. Simultaneously with this button pushing, the roller rotation command signal (for making the command of rotation of the roller 33) is changed to its ON state from its OFF state, thereby causing the roller 33 to rotate through the inverter 124. At this time, the loom starring permission signal for permitting the starting of the loom is changed from its ON state to its OFF state in which the loom stating is not permitted. That is to say, the loom starting is not permitted until the rotational speed of the roller 33 reaches the predetermined level. This is because a mispick will occur if the rotational speed of the roller 33 is lower than the predetermined level. The loom starting permission signal takes its ON state at a time t2 when it is confirmed that a predetermined time has been lapsed from the time t1 or the rotational speed of the roller 33 has reached the predetermined level. Then, the start button 121*b* is pushed manually, for example, at a time t3 thereby starting the weaving operation of the loom. The above operations are in a loom normal weaving operation.

Figure 11:
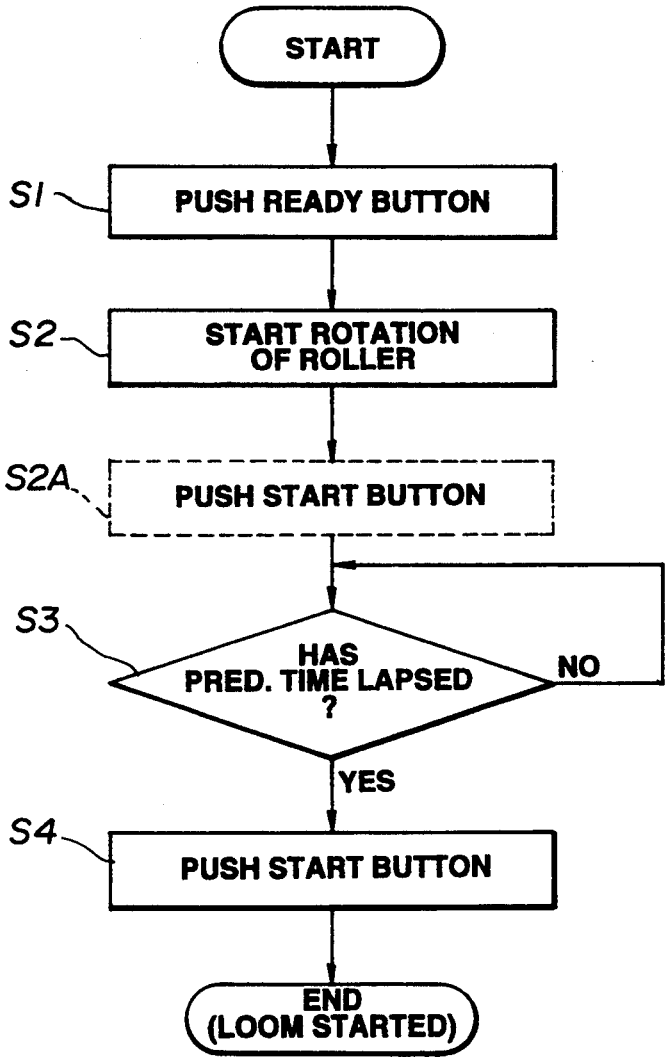
FIG. 11 is a flowchart showing the control of the weft picking system of FIG. 1 during a time period from stopping to re-starting of the loom.

The above weaving operation starting will be further discussed with reference to a flowchart of FIG. 11. In the flowchart, the ready button 121*a* is pushed at a step S1 and therefore the rollers 33, 35 of the weft traction device 30 start rotating at a step S2. A decision is made as to whether the predetermined time has lapsed at a step S3. In case of NO, a flow goes back to the step S3. In case of YES, the flow goes to a step S4 at which the weaving operation of the loom is started by pushing the start button 121*b*. It will be appreciated that even if the start button 121*b* is pushed immediately after the step S2 as indicated as an imaginary step S2A, the main motor 7 cannot be rotated and therefore no weaving operation is started. Upon lapse of the predetermined time, the main motor 7 starts its rotation for the first time to accomplish the weaving operation.

Figure 12:
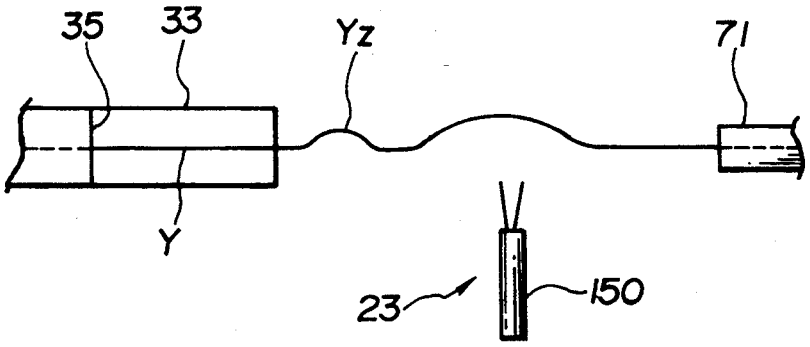
FIG. 12 is an illustration of an essential part of the first embodiment weft picking system provided with a second example of the weft yarn slackened portion deforming device.

FIG. 12 illustrates a second example of the weft yarn slackened portion deforming device 23 forming part of the weft picking system E of the present invention, and therefore may be used in place of the corresponding device 23 in FIGS. 1 and 2. The weft yarn slackened portion deforming device 23 includes a fluid (air) ejection nozzle 150 disposed near the path of the weft yarn Y between the weft traction device 30 and the weft posture regulating nozzle 71. With this device 23, compressed air is blown from the nozzle 150 in a direction perpendicular to the path of the weft yarn Y so that the moving weft yarn Y receives air pressure from a side direction. As a result the moving path of the weft yarn Y is prolonged thereby deforming and smoothening the slackened portion Yz to be stored there. When the tractive force (speed) of the weft posture regulating nozzle 71 increases over that of the weft traction device 30, the slackened portion Yz is disappeared and restored to its original shape. The weft yarn slackened portion deforming device 23 of this example is very simple in construction and low in production cost.

Figure 13:
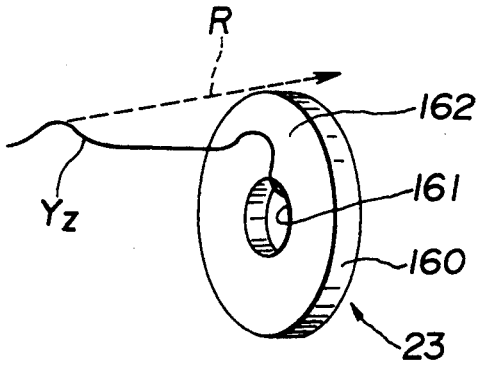
FIG. 13 is a perspective enlarged view of an essential part of the first embodiment weft picking system provided with a third example of the weft yarn slackened portion deforming device.
Figure 14:
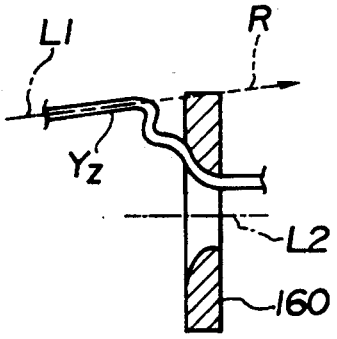
FIG. 14 is a vertical sectional view of a part of the weft yarn slackened portion deforming device of FIG. 13.
Figure 15:
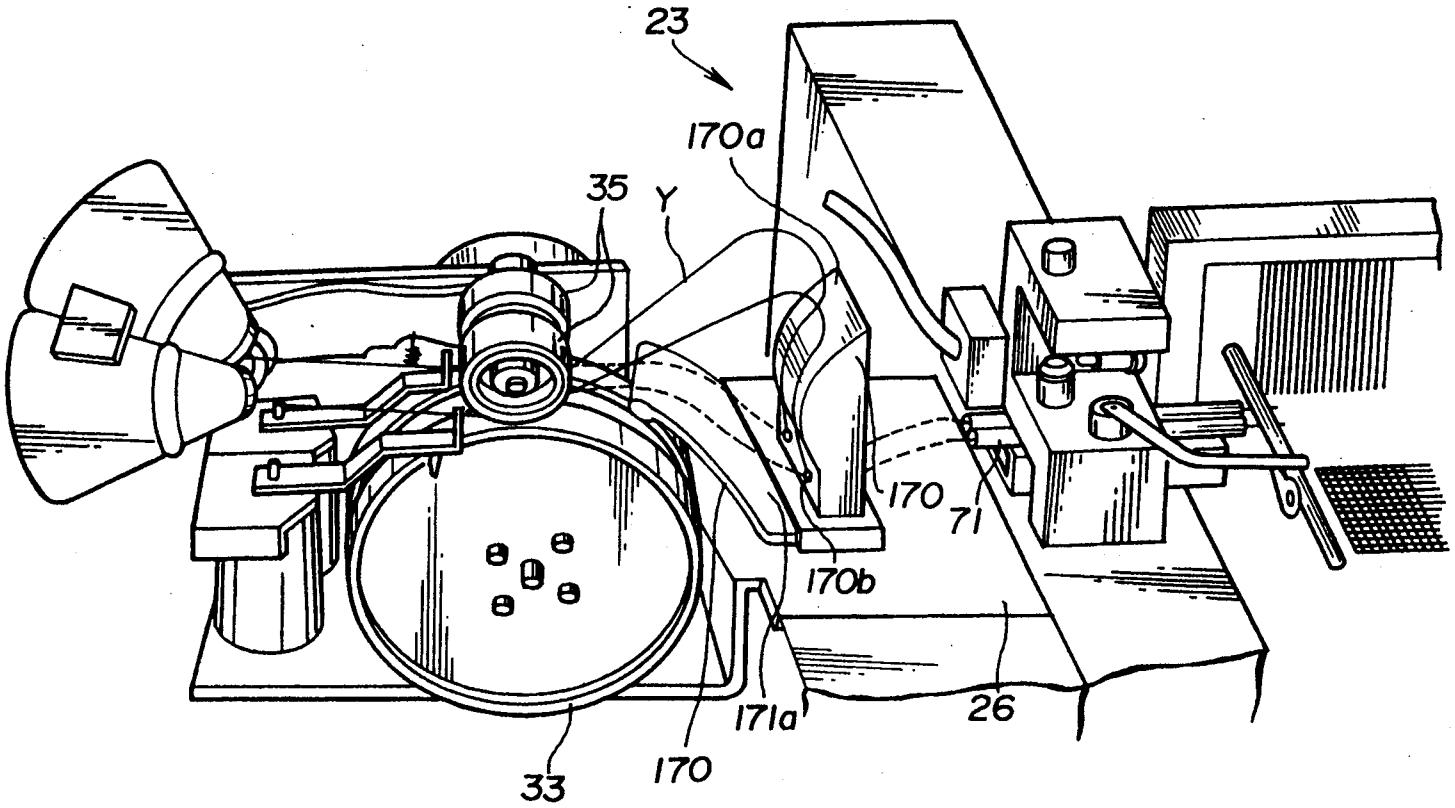
FIG. 15 is a perspective view of an essential part of the first embodiment weft picking system provided with a fourth example of the weft yarn slackened portion deforming device.

FIG. 13 and 14 illustrate a third example of the weft yarn slackened portion deforming device 23 forming part of the weft picking system E of the present invention, and therefore it may be used in place of the corresponding device 23 in FIGS. 1 and 2. The device 23 of this example includes a generally annular weft yarn contacting member 160 forming a central through-hole or weft yarn introduction hole 161. The locational relationship of the weft yarn contacting member 160 relative to the weft traction device 30 is arranged such that the above-mentioned imaginary plane L1 (containing the direction R) is offset from or not aligned with the plane L2 containing the axis of the hole 161 of the weft yarn contacting member 160 as shown in FIG. 14. The weft yarn contacting member 160 has a front annular flat and smooth surface 162 with which the slackened portion Yz of the weft yarn Y is brought into contact, so as to be stored thereon. This weft yarn contacting member 160 serves also as a yarn guide.

Figure 16:
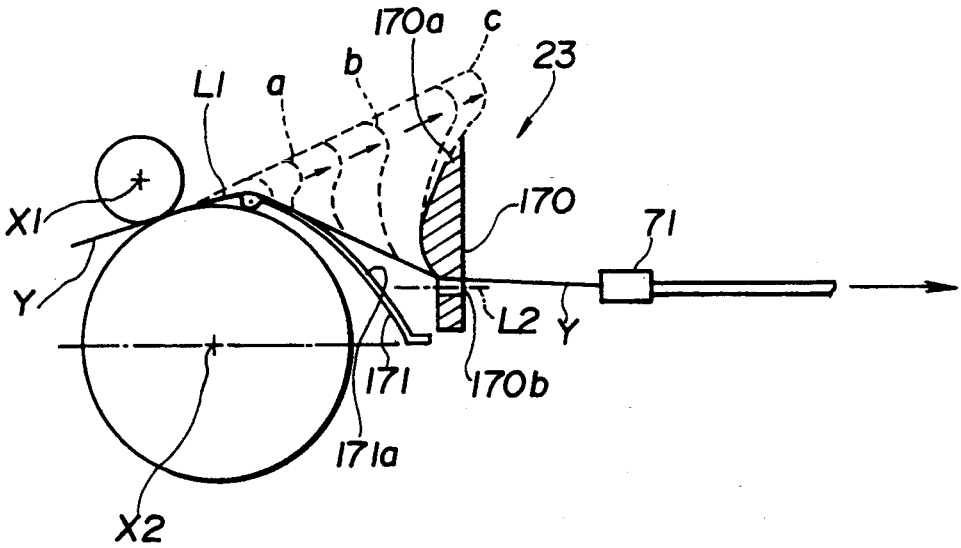
FIGS. 16 and 17 are illustrations showing the movement of the slackened portion of the weft yarn during a weft picking, in the weft picking system of FIG. 15.

FIGS. 15 to 21 illustrate a fourth example of the weft yarn slackened portion deforming device 23 forming part of the weft picking system E of the present invention, and may be replaced with the corresponding device 23 in FIGS. 1 and 2. The weft yarn slackened portion deforming device 23 of this example includes a first weft guide member 170 which is mounted on the stationary base 26 and stands vertically. The first weft yarn guide member 170 is formed at its front face with a laterally extending generally semicylindrical guide surface 170*a*. The first weft yarn guide member 170 is formed with a weft yarn introduction hole 170*b* located below the guide surface 170*a*. The first weft yarn guide member 170 is located in a manner that the guide surface 170*a* generally faces the roller 33 of the weft traction device 30 while the weft yarn guide hole 170*b* faces or aligns with the weft posture regulating nozzle 71. The locational relationship between the weft traction device 30 and the weft yarn introduction hole 170*b* is arranged such that the imaginary plane L2 containing the axis of the weft introduction hole 170*b* is offset from or not aligned with the imaginary plane L1 of the weft traction device 30 as shown in FIG. 16.

A second weft yarn guide member 171 is mounted on the stationary base 29 and located adjacent the first weft yarn guide member 171. The second weft yarn guide member 171 is formed of a flat plate and curved to extend generally along the cylindrical peripheral surface of the roller 33 as clearly shown in FIGS. 16 to 21, thus forming a curved guide surface 171*a* which faces the guide surface 170*a* of the first weft yarn guide member 170. The second weft guide member 171 is installed in a manner to cover a part of the cylindrical peripheral surface of the roller 33.

With this weft yarn slackened portion deforming device 23, by virtue of the first weft yarn guide member 170, the slackened portion Yz of the weft yarn Y pushed by the weft traction device 30 is released into a space above the second weft yarn guide member 171*a* to be stored therein, preventing the slackened portion Yz from striking against a portion around the weft yarn introduction hole 17*b*. Meanwhile, the traction force (speed) of the weft posture regulating nozzle 71 is increased over that of the weft traction device 30 thereby drawing the weft yarn so that the slackened portion Yz disappears, thus preventing the weft yarn from being fluffy.

By virtue of the second weft yarn guide member 171, the weft yarn waving on the side of the roller 33 is smoothly guided when the Z-shaped slackened portion Yz of the weft yarn Y is gradually diminished and the weft yarn Y is drawn into the weft posture regulating nozzle 71 at the last stage of the weft picking. As a result, introduction of the weft yarn into the weft posture regulating nozzle 71 is smoothly made while being preveted from contacting with the roller 33 and the like.

Figure 17:
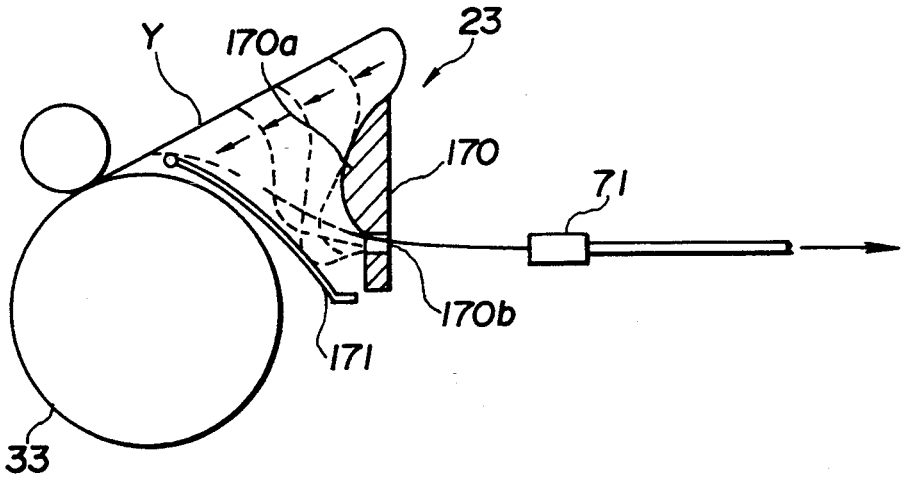
Figure 18:
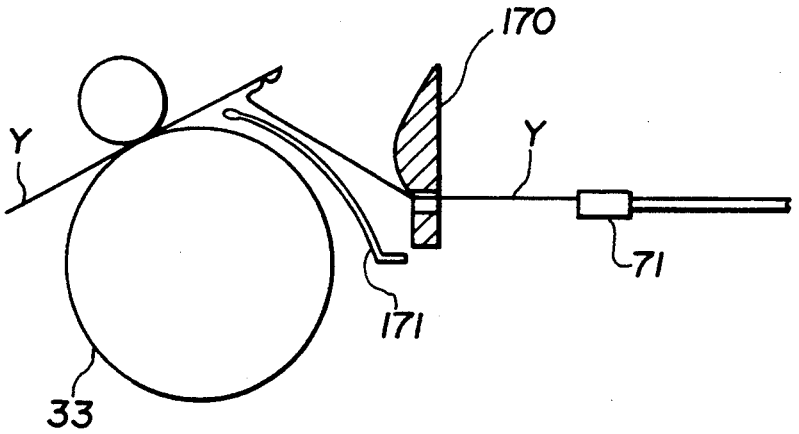
FIGS. 18 to 21 are illustrations showing the change in shape of the weft yarn slackened portion with lapse of time, in the weft picking system of FIG. 15.
Figure 19:
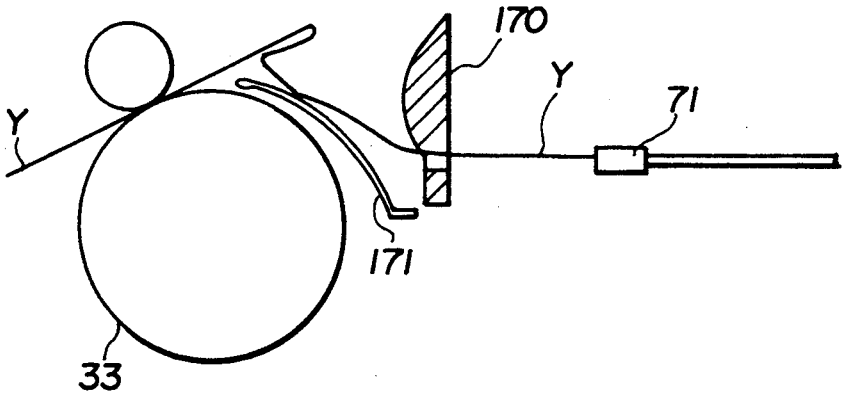
Figure 20:
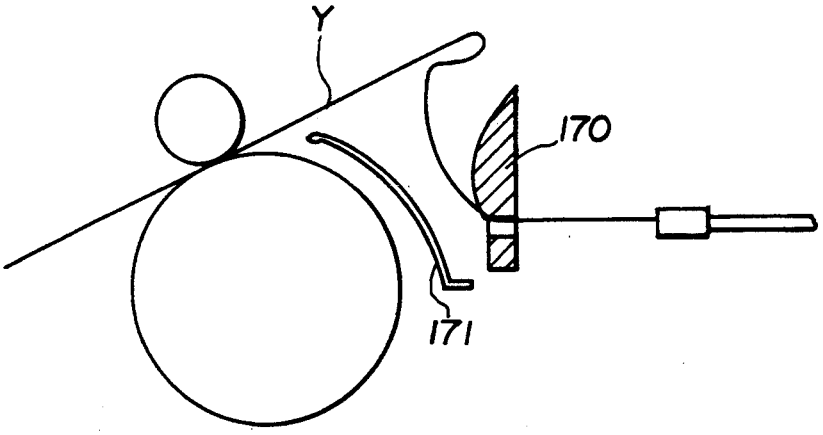
Figure 21:
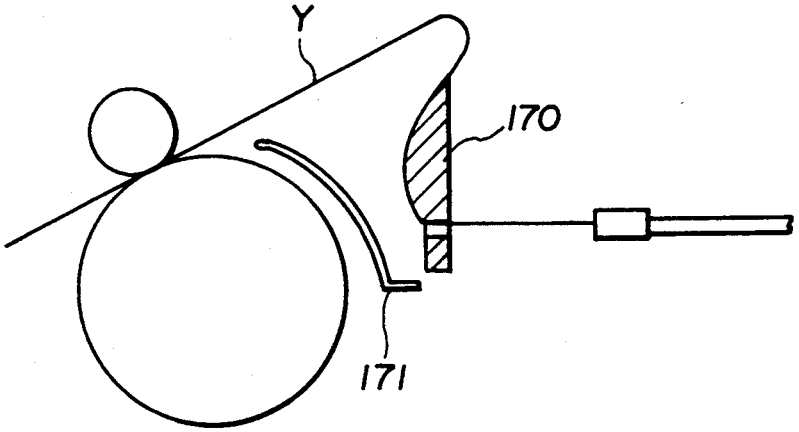

In operation, when the traction action of the weft traction device 30 is initiated as shown in FIGS. 16 and 17, the Z-shaped slackened portion Yz of the weft yarn Y gradually enlarges in the order of a, b and c as indicated in FIG. 16 and is stored between the first and second weft yarn guide members 170, 171. As the traction force (speed) of the weft posture regulating nozzle 71 increases over that of the weft traction device 30, the Z-shaped slackened portion Yz of the weft yarn Y gradually decreases in the order of c, b and a as indicated in FIG. 17.

In a state where the Z-shaped slackened portion Yz is the largest and located on the guide surface 170*a* as indicated by c in FIG. 16, the weft yarn Y is smoothly introduced into the weft yarn introduction hole 170*b* along the guide surface 170*a* which is formed such as to fit with the shape of the weft yarn Y. Then, the weft yarn Y is pulled along the guide surface 171*a* of the second weft yarn guide member 171, and the weft yarn Y is pressed on the guide surface 171*a* while being guided, so that the slackened portion Yz is further flattened and smoothened.

Although the shape of the weft yarn slackened portion Yz has been shown simple for the purpose of simplicity of illustration it changes complicatedly and minutely in practice as indicated in FIGS. 18 to 21 and in the order of from FIGS. 18 to 21. As apparent from the above, the shape of the weft yarn slackened portion Yz is gradually changed from a state in which a small Z-shaped entanglement is formed to a state in which the entanglement is loosened thereby enlarging the Z-shaped slackened portion Yz.

Figure 22:
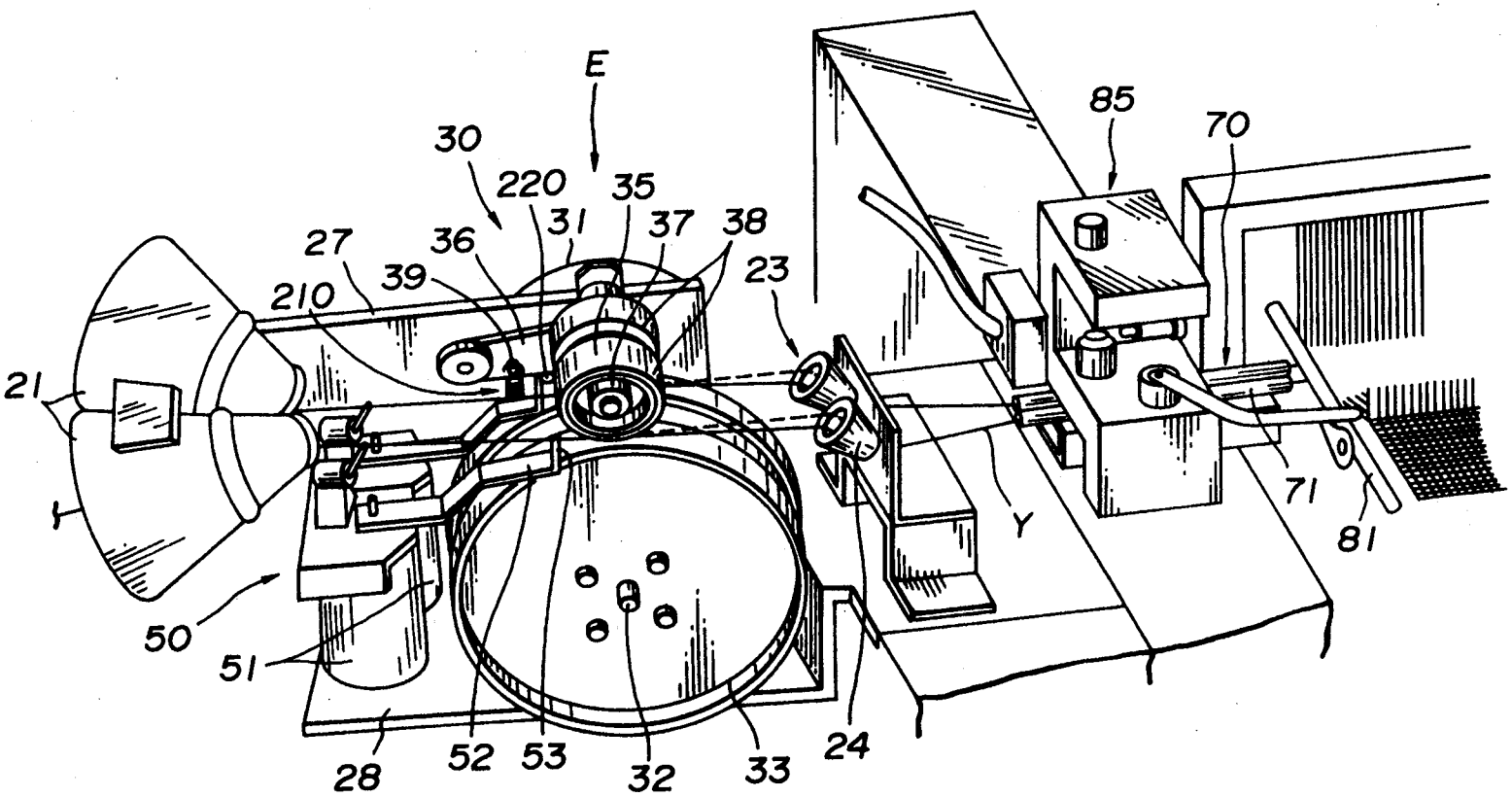
FIGS. 22 is a perspective view of an essential part of a second embodiment of the weft picking system according to the present invention, provided with an example of a roller locational relationship adjusting device.
Figure 23:
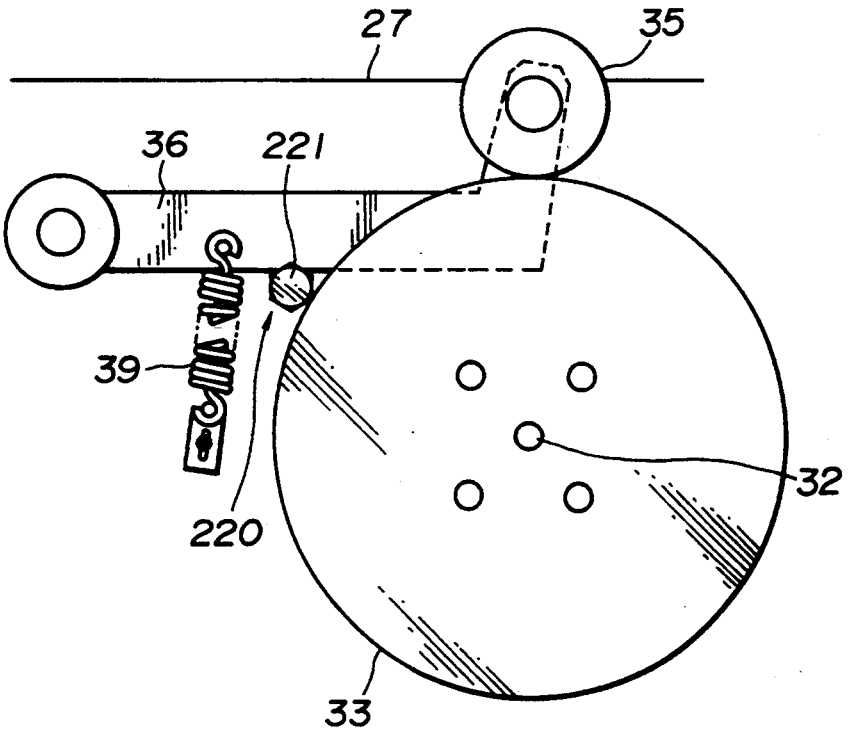
FIG. 23 is a side view of an essential part of the roller locational relationship adjusting device of FIG. 22.
Figure 24:
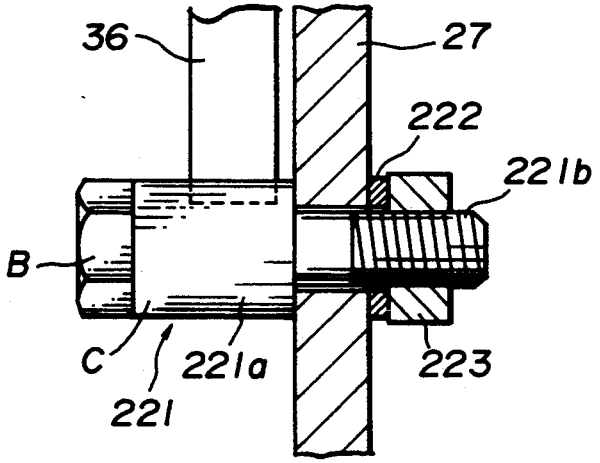
FIG. 24 is a fragmentary vertical sectional view of a part of the device of FIG. 23.

FIGS. 22 to 24 illustrate a second embodiment of the weft picking system of the present invention, similar to the first embodiment except for a roller locational relationship adjusting device 210. In this embodiment, the roller locational relationship adjusting device 210 functions to adjust the locational relationship between the small diameter roller 35 and the large diameter roller 33, and includes a stopper 220 which is disposed under the arm 36 that supports the small diameter roller 35 in order to restrict the downward movement of the arm 36. The stopper 220 includes an eccentric bolt 221 which has a head section 221*a* and a screw section 221*b* formed with an external thread. The head section 221*a* includes a hexagonal bolt head portion B and a cylindrical portion C which are integral and coaxial with each other. The screw section 221*b* is integral with and eccentric relative to the head section 221*a*. In other words, the axis of the screw section 221*b* is not aligned with that of the head section 221*a*.

As shown in FIG. 24, the arm 36 is in press contact with the cylindrical surface of the cylindrical portion C of the eccentric bolt 221 under the action of the tension spring 39. The screw section 221*b* is inserted in a through-hole (not identified) formed in the vertical wall 27 and projects to the back side of the vertical wall 27. A nut 223 is engaged on the screw section 221*b* and tightened through a washer 222 disposed between the vertical wall 27 and the nut 223.

With the arrangement of FIGS. 22 to 24, when the small diameter roller 35 provided with the rubber layer 38 is brought into press contact with the large diameter roller 33, the downward movement of the arm 16 is restricted by the head section 221*a* of the eccentric bolt 221. More specifically, by virtue of the eccentric arrangement between the head section 221*a* and the screw section 221*b*, the vertical location of the lower edge of the arm 36 can be changed between its upper position indicated by solid line and its lower position Indicated by dotted line in FIG. 24 by rotating the head section 221*a*. This makes possible a minute adjustment of the vertical position of the arm 36 supporting the small diameter roller 35.

Accordingly, a press contact force of the small diameter roller 35 to the large diameter roller 33 is set at a suitable value thereby preventing the reduction of durability of the small diameter roller (provided with the rubber layer 38) from a press contact force which is too high. It will be understood that meant by the "press contact force" is a force at which the small diameter roller 35 is in press contact with the large diameter roller 33. Additionally, a radial deformation amount of the rubber layer 38 of the small diameter roller 35 upon being in press contact with the large diameter roller 33 can be set at such a suitable value that no slip is made between the rollers 33, 35 while preventing waving of the rubber layer 38 of the roller 35. Accordingly, the stopper 220 can restrict a deflection amount of the rubber layer 38 of the small diameter roller 35 within a suitable range.

Figure 25:
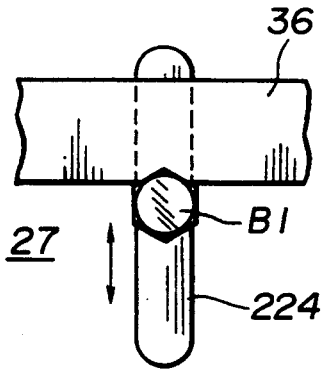
FIG. 25 is a fragmentary side view of a part of a modified example of the roller locational relationship adjusting devise of FIG. 22.

FIG. 25 shows an essential part of a modified example of the stopper 220 in the weft picking system of FIG. 22, similar to the first example shown in FIGS. 23 and 24. In this example, a usual bolt and nut connection may be used in place of the eccentric bolt 221 though only the bolt B1 is shown. The bolt B1 is slidably located in a vertically elongated slot 224 formed in the vertical wall 27 and fixed with the nut (not shown) which is engaged with the bolt B1 and located on the back side of the vertical wall 27. Adjustment of the vertical location of the arm 16 can be made by vertically changing the position of the bolt B1.

Figure 26:
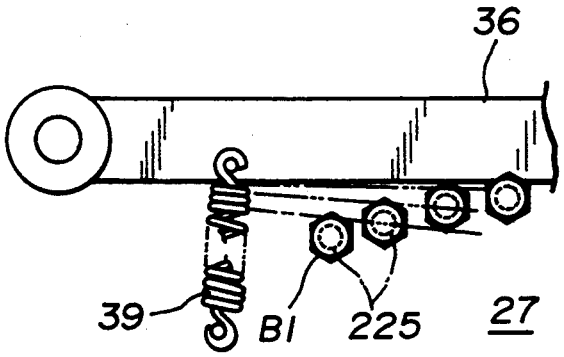
FIG. 26 is a fragmentary side view of a part of another modified example of the roller locational relationship adjusting device of FIG. 22.

FIG. 26 shows another modified example of the stopper 220 similar to the stopper 220 in FIG. 25 with the exception that a plurality of through-holes 225 are formed in the vertical wall 27 in place of the slot 224. In this example, the vertical position of the bolt B1 is changeable by locating the bolt at each of the through-holes 225 thereby adjusting the vertical position of the arm 36.

Figure 27:
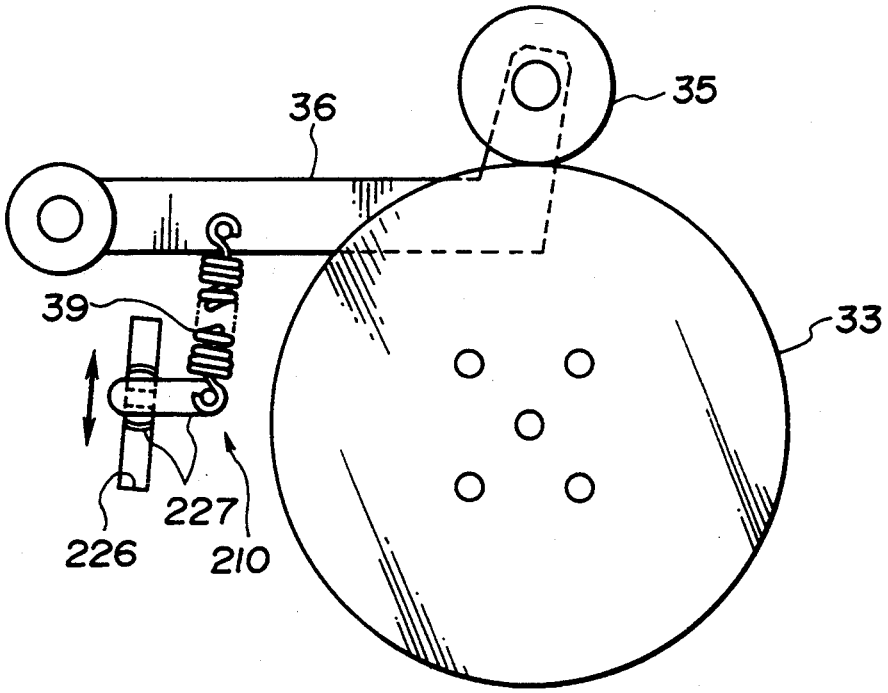
FIG. 27 is a side view of a further modified example of the roller locational relationship adjusting device of FIG. 22.

FIG. 27 shows a second example of the roller locational relationship adjusting device 210 which may be used in place of the device 210 in the weft picking system shown in FIG. 22. The roller locational relationship adjusting device 210 of this example includes an spring installation member 227 to which the lower end of the tension spring 39 is fixedly secured. A part of the spring installation member 227 is slidably disposed in a vertically elongated slot 226 formed in the vertical wall 27 and arranged to be fixable at a position in a vertical direction along the slot 226.

With the arrangement of FIG. 27, the position of the lower end of the tension spring 39 is made changeable so as to alter a set press contact force of the small diameter roller 35, thereby adjusting the press contact force within a range in which no trouble arises. Additionally, a dispersion in biasing force of the spring 39 (springs) can be effectively absorbed by minutely adjusting the installation position of the lower end of the spring 39, thus preventing heat generation from arising owing to an unsuitable press contact force of the small diameter roller 35 to the large diameter roller 33.

Although some examples of the roller locational relationship adjusting device 210 have been shown and described, it will be understood that the roller locational relationship adjusting device 210 is not limited in construction and arrangement to the examples, in which a stopper mechanism shown as FIGS. 24 to 26 and a spring installation mechanism as shown in FIG. 27 may be incorporated to constitute the roller locational relationship adjusting device 210.

Figure 28:
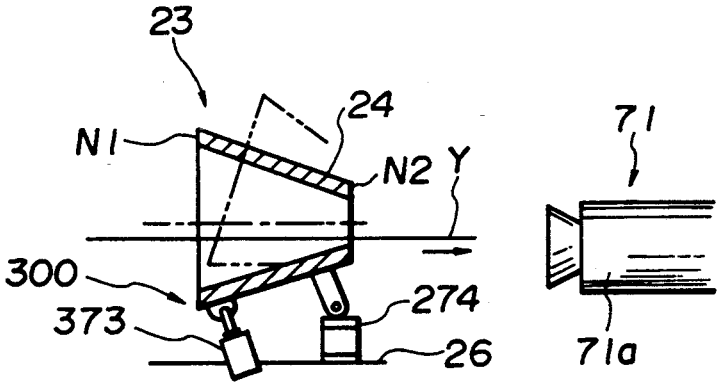
FIG. 28 is a vertical sectional view of an essential part of a third embodiment of the weft picking system, showing an example of a weft threading direction regulating device.

FIG. 28 illustrates an essential part of a third embodiment of the weft picking system E according to the present invention, similar to the first embodiment except for a weft threading direction regulating device 300 disposed associated with the weft yarn contacting member 24 of the weft yarn slackened portion deforming device 23. In this embodiment, the weft yarn contacting member 24 is mounted on the stationary base 26 through an air cylinder 373 and a pivotally supporting member 274. More specifically, the air cylinder 373 is mounted on the stationary base 26 and connected to the front end portion N1 of the weft yarn contacting member 24 to vertically move the front end portion N1. The pivotally supporting member 274 is mounted on the stationary base 26 and connected with the rear end portion N2 of the weft yarn contacting member 24 to allow the rear end portion N2 to pivotally move around a pivot axis (not identified) of this member 274

With the arrangement of FIG. 28, when a threading operation of the weft yarn Y is made in the loom, for example, at a re-start of the weaving operation of the loom, the air cylinder 373 is contracted to lower the front end portion N1 of the weft yarn contacting member 24 so as to allow the axis of the weft contacting member 24 to direct to the weft posture regulating nozzle 71. In the weft yarn threading operation, the weft yarn Y is guided along the path of the weft yarn Y in the loom (including a part of the weft yarn path between the weft traction device 30 and the weft posture regulating nozzle 71). Then, air stream is formed along the weft yarn path when a weft threading device (not identified) is operated. The weft threading device functions to carry the weft yarn Y along the weft yarn path under the action of the air stream, and therefore includes an air ejection nozzle 375 (See FIG. 1 and an air suction device **71*a* which forms part of the weft posture regulating nozzle 71. Upon 2O air ejection of the air ejection nozzle 375, the air stream is formed and introduced through the weft winding arm 13. The air stream flows out of the tip end of the weft winding arm 13 and is directed to the yarn guide 21. The yarn guide 21 generates an air stream which is directed toward the traverse lever 52 and is continuous to the air stream from the weft winding arm 13. The air stream passes through the traverse lever 52 of the change-over device 50 and then is guided to bypass the rollers 33, 35 of the weft traction device 30 under,the action of a guide member (not shown). Thereafter, the air stream is introduced into the weft yarn contacting member 24 through the front end portion N1 and flown out of the weft contacting member 24 through the rear end portion N2**.

The weft yarn Y to be threaded is carried from the yarn supply member 1 (in FIG. 1) by the above-mentioned air stream along the weft yarn path and introduced into the weft yarn contacting member 24. Here, since the axis of the weft yarn contacting member 24 is directed to the weft posture regulating nozzle 71, the weft yarn Y in the weft yarn contacting member 24 is effectively transferred to the weft posture regulating nozzle 71. This transferring action of the weft yarn Y is assisted under the air suction on the side of the weft posture regulating nozzle 71 at the air suction device **71*a***.

While only the air cylinder 373 has been shown and described, it will be understood that it may be replaced with a mechanically operated actuator or the like.

Figure 29:
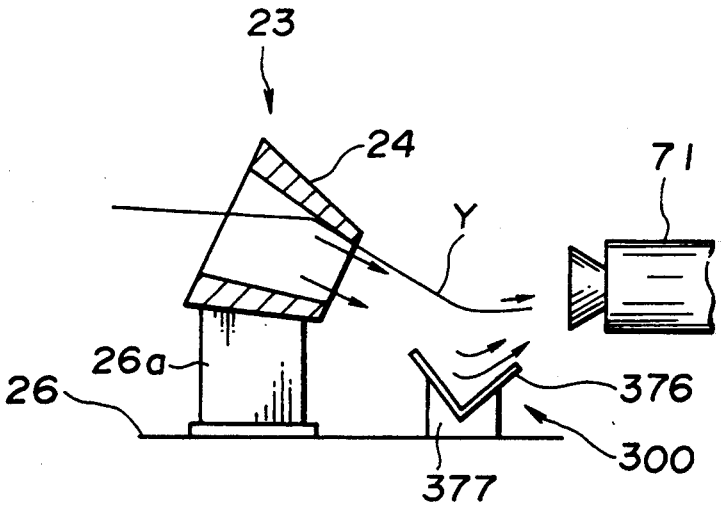
FIG. 29 is a vertical sectional view similar to FIG. 28 but showing a modified example of the weft threading direction regulating device of FIG. 28.

FIG. 29 shows a modified example of the weft threading direction regulating device 300 of the third embodiment weft picking system E. In this example, the weft yarn contacting member 24 is fixedly mounted through the stand member 26a on the stationary base 26. An air stream direction changing plate 376 forming part of the weft threading direction regulating device 300 is mounted through a support member 377 on the stationary base 26. The air stream direction changing plate 376 is L-Shaped in cross-section as shown in FIG. 29.

Under air guide action of this air stream direction changing plate 376, the air stream from the weft yarn contacting member 24 is bent and directed to the weft posture regulating nozzle 71 thereby effectively accomplishing the weft threading, particularly, from the weft yarn slackened portion deforming device 23 to the weft posture regulating nozzle 71.

Figure 30:
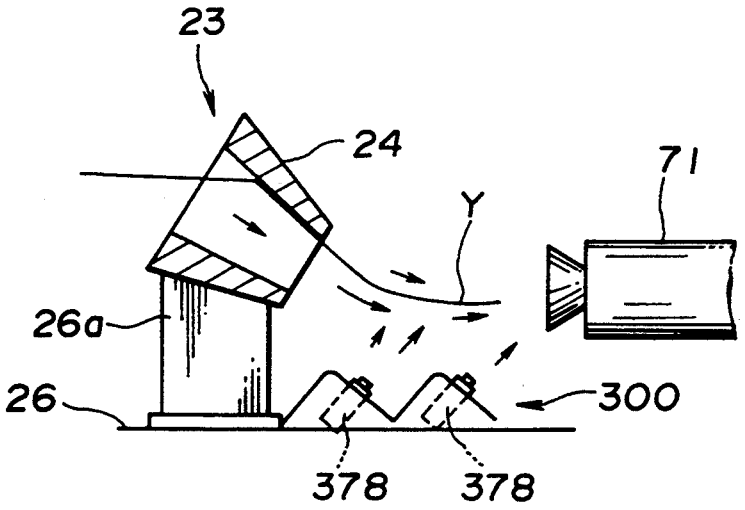
FIG. 30 is a vertical sectional view similar to FIG. 28 but showing a further modified example of the weft threading direction regulating device of FIG. 28.

FIG. 30 shows a further modified example of the weft threading direction changing device 300 of the third embodiment weft picking system E, similar to that of FIG. 29. In this example, the weft threading direction changing device 300 includes a pair of air ejection nozzles 378 which are disposed on the stationary base 26 and located between the weft yarn slackened portion deforming device 23 and the weft posture regulating nozzle 71. The air ejection nozzles 378 eject air in directions respectively indicated by arrows in FIG. 30 thereby to effectively direct the air stream to allow the weft yarn Y to be directed to the weft posture regulating nozzle 71.

It will be appreciated that at least one of the air ejection nozzles 378 may be combined with the air stream direction changing plate 376 to further improve the air stream direction changing effect.

Figure 31:
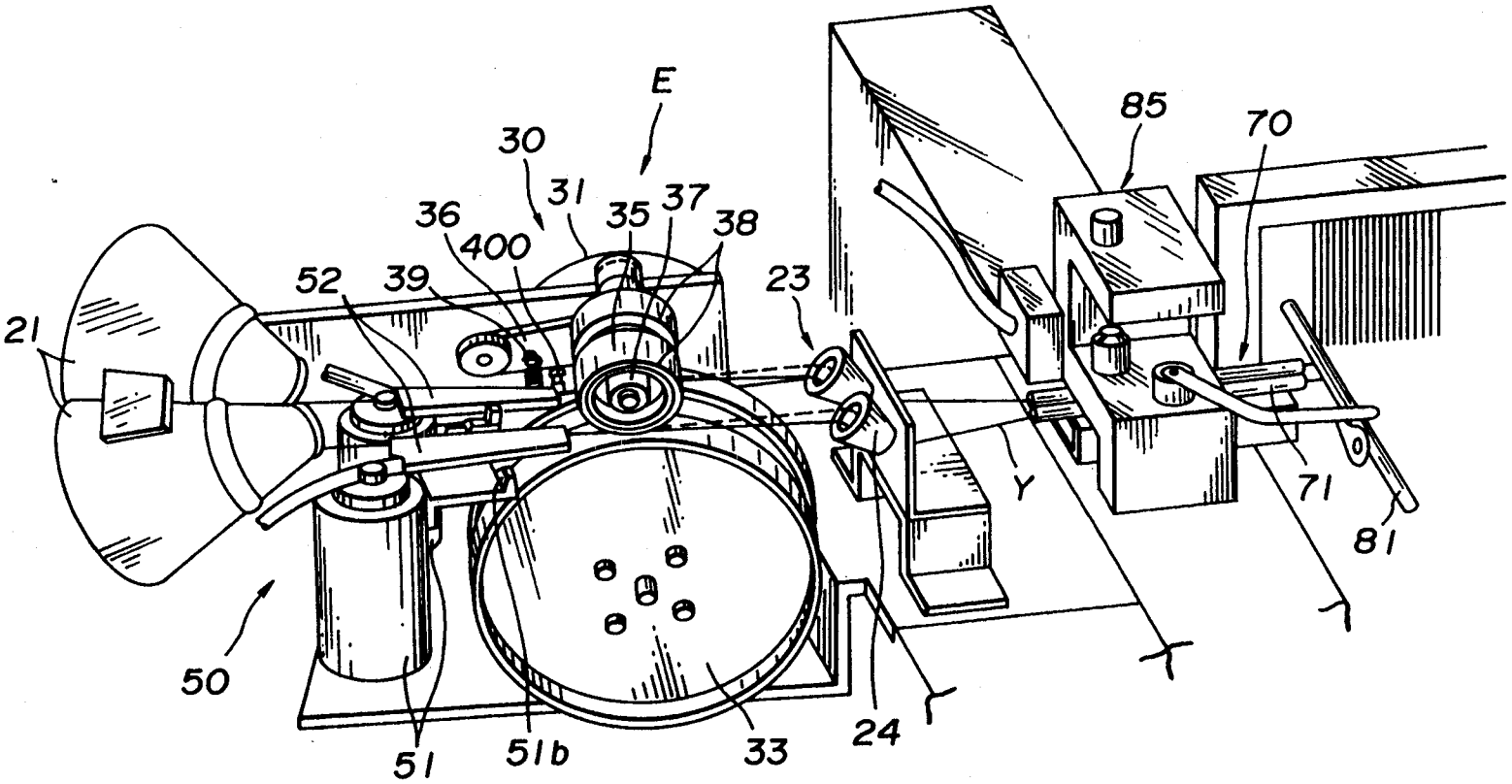
FIG. 31 is a perspective view of an essential part of a fourth embodiment of the weft picking system of the present invention, provided with a modified example of a change-over device.
Figure 32:
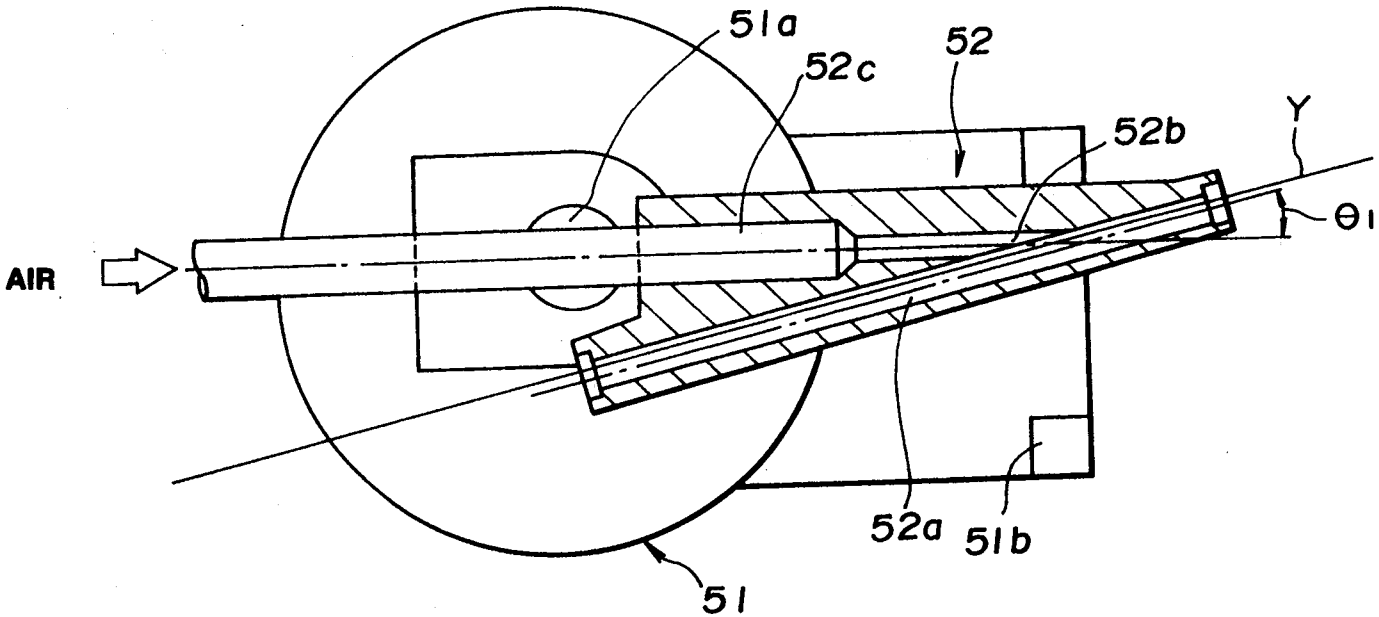
FIG. 32 is an enlarged transverse sectional view of an essential part of the change-over device of FIG. 31.

FIGS. 31 and 32 illustrate a fourth embodiment of the weft picking system E according to the present invention, which is similar to the first embodiment of FIGS. 1 and 2 except for the structure of the change-over device 50. In this embodiment, the traverse lever 52 of the change-over device 50 is fixed on the power output shaft 51a of the rotary solenoid 51 to be rotatable around the axis of the power output shaft 51a. A stopper 51b is fixedly secured to the rotary solenoid 51 and such located as to restrict a moving range of the traverse lever 52.

As clearly shown in FIG. 32, the traverse lever 52 is formed with a weft guide passage 52a through which the weft yarn Y from the yarn guide 21 is passed. The weft guide passage 52a is straight and elongated and has an axis which is directed generally to a surface at which the rollers 33, 35 contact with each other. Additionally, a straight, elongated air ejection nozzle 52b is formed in the traverse lever 52 and connected to the weft guide passage 52a at the downstream side The air ejection nozzle 52b functions to eject air to the downstream side of the weft guide passage 52a. The weft guide passage 52a and the air ejection nozzle 52b are arranged such that the axes of them intersect at an angle $\theta 1$ not larger than 30 degrees as viewed from the above, as illustrated in FIG. 32, so that the path of the air stream during the weft yarn threading operation is not bent while preventing the air stream from flowing backward or toward the upstream side of the weft guide passage 52a. An air supply pipe (formed, for example, of polyurethane resin) 52c is connected to the air ejection nozzle 52b and fixed to the traverse lever 52. Compressed air is supplied from an pressurized air source (not shown) through the pipe 52c to the air ejection nozzle 52b during the weft yarn threading operation.

As best shown in FIG. 32, the air supply pipe 52c is located above the power output shaft 51a of the rotary solenoid 51 in such a manner that the axis thereof passes through (the axis of) the power output shaft 51a as viewed from the above. Accordingly, the air supply pipe 52c is effectively prevented from being hardly swished even upon high speed swinging movement of the traverse lever 52 thereby prolonging the life of the air supply pipe 52c while minimizing a resistance to the swinging movement of the traverse lever 52.

The stopper 51b is located to be contactable with a relatively thick wall section (not identified) of the traverse lever 52 in which the weft guide passage 52a and the air jet nozzle 52b are connected to each other, so that the traverse lever 52 is sufficient in durability even though it strongly strikes against the stopper 51b. Additionally, the center of gravity of the traverse lever 52 resides generally at the relatively thick wall section, and therefore vibration of the traverse lever 52 is effectively reduced while preventing the swinging movement of the traverse lever 52 from becoming unstable. In FIG. 31, the reference numeral 400 designates an air cylinder disposed under the arm 36 and arranged to move the arm 36 upwardly when operated.

The operation of the arrangement of FIGS. 31 and 32 will be discussed with reference to FIGS. 33A to 33C.

Figure 33A:
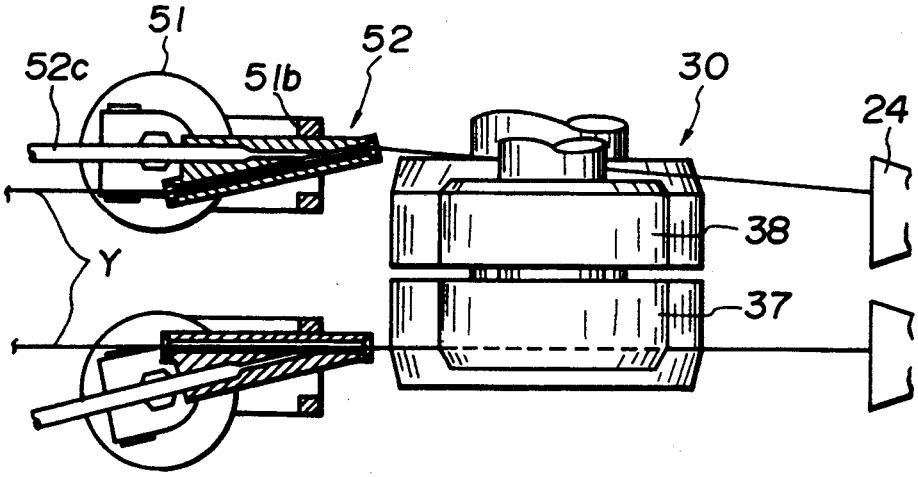
FIGS. 33A to 33C are fragmentary plan views (partly in section) showing operation of the change-over device.

First, during a normal weaving operation of the loom, as shown in FIG. 33A, the tip end of one of the traverse levers 52, 52 is directed to the contacting surface of the rollers 33, 35 to put the weft yarn Y in the weft engaged condition to be located between the rollers 33, 35. The tip end of the other traverse lever 52 is directed shift from the contacting surface of the rollers 33, 35 thereby putting the weft yarn Y in the weft disengaged condition to be located separate from the rollers 33, 35. It will be understood that, at this time, no air is ejected from the air ejection nozzle 52b.

Figure 33B:
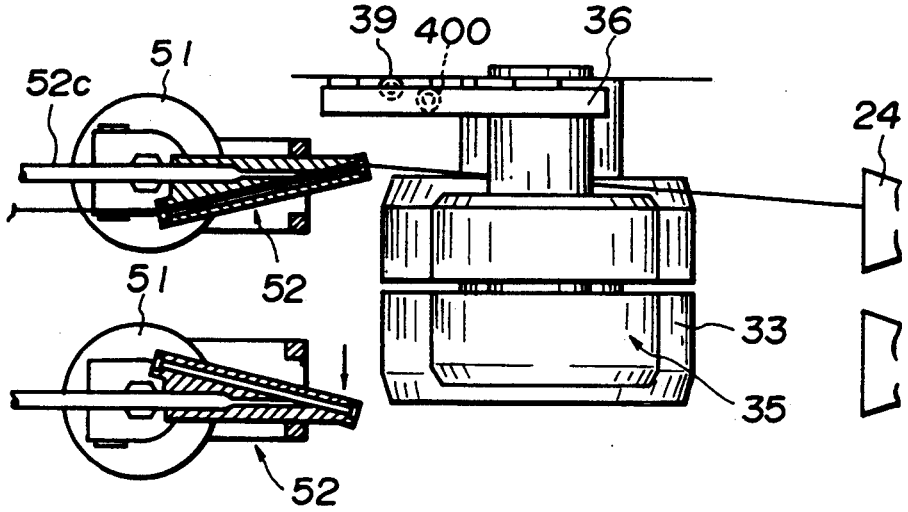

Under this condition, if the weft yarn Y is broken or cut in its path for a weft picking and accordingly the weaving operation is stopped in response to this weft yarn breakage, the engaging pin 14 (in FIG. 1) of the weft measuring and storing device 10 is inserted in the drum 11, and the lower one (in FIG. 33A) of the traverse levers 52 is put into the disengaged condition so that both the traverse levers 52, 52 are in the disengaged condition as shown in FIG. 33B. This prevents the weft yarn Y from being broken owing to high speed traction by the rotating rollers 33, 35, until the rollers 33, 35 stop. Thereafter, an air cylinder 400 is operated to upwardly move the arm 36 thereby upwardly displacing the small diameter roller 35. As a result, a clearance is formed between the rollers 33, 35 to allow the weft yarn Y to be passed through the clearance for the purpose of accomplishing the threading operation of the weft yarn Y.

Figure 33C:
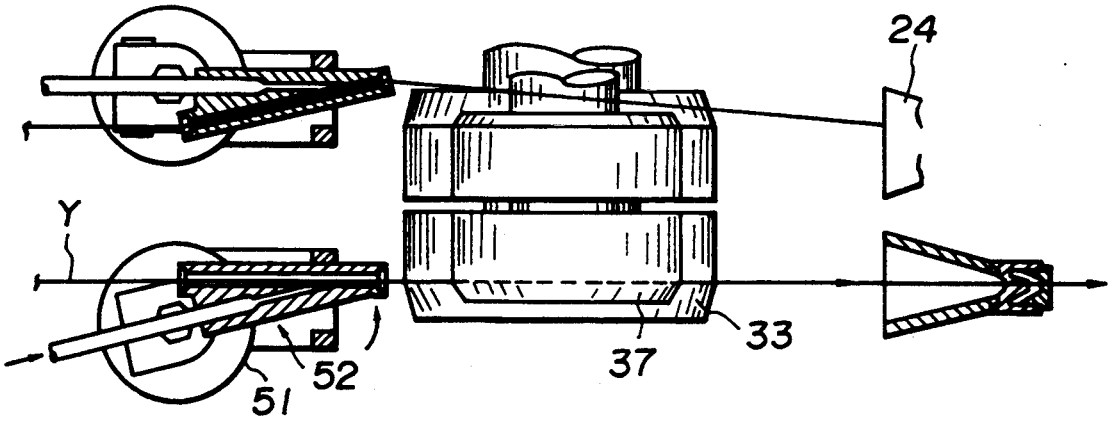

In order to accomplish the threading operation of the weft yarn Y, as shown in FIG. 33C, the lower rotary solenoids 51 is operated to direct the tip end of the lower traverse lever 52 to the contacting surface of the rollers 33, 35 and put the lower traverse lever 52 in a position at which the weft yarn Y is to be drawn by the rollers 33, 35. Here, for example, in case the weft yarn Y is broken at a position near the yarn supply member 1, the broken weft yarn Y is removed from the path of the weft yarn Y and then the threading operation of the weft yarn Y is carried out as follows: Upon air ejection from the air ejection nozzle 375 (in FIG. 1), the weft yarn Y is blown and guided through the weft winding arm 13 to the yarn guide 21. When the weft yarn Y reaches the yarn guide 21, air ejection of the air ejection nozzle 375 is stopped. Then, air ejection from an air ejection nozzle (not shown) provided in the yarn guide 21 and air ejection from the weft posture regulating nozzle 71 are started. At this time, the air ejection nozzle 52b starts its air ejection at a high speed to supply air into the weft guide passage 52a. As a result, vacuum is generated at a portion of the air guide passage 52a upstream of a location at which the air guide passage 52a and the air ejection nozzle 52b are connected with each other, under the action of the high speed air stream from the air ejection nozzle 52b.

When the weft yarn Y is brought to a position near the upstream end of the weft guide passage 52a under the action of air jet from the air ejection nozzle 52b in the yarn guide 21, the weft yarn Y is sucked smoothly and drawn into the weft guide passage 52a by virtue of the above-mentioned vacuum generated in the weft guide passage 52a. Then, the weft yarn Y from the weft guide passage 52a of the traverse lever 52 is fed through the weft traction device 30 to the weft yarn slackened portion defoming device 23. Thereafter, the weft yarn Y is introduced into the weft posture regulating nozzle 71 under the influence of air jet ejected from an air ejection section (not shown) in the weft yarn slackened portion deforming device 23.

It will be appreciated that provision of the air ejection nozzle 52b facilitates the threading operation of the weft yarn by an operator thereby reducing the operator workload for the loom.

While the embodiment of the weft picking system E of FIGS. 31 and 32 has been shown and described as being arranged such that air is ejected to the weft guide passage 52a formed in the traverse lever 52, it will be understood that a fluid to be ejected to the weft guide passage is not limited to air, so that other fluids such as water or gas may be ejected.

What is claimed is:

1. A weft picking system for a fluid jet loom, comprising:

means for measuring a predetermined length of a weft yarn and storing it prior to a weft picking;

a weft posture regulating nozzle for regulating a posture of the weft yarn which is fed from said measuring and storing means and for ejecting a fluid jet to pick the weft yarn into a shed of warp yarns;

a weft traction device disposed between said measuring and storing means and said weft posture regulating nozzle, said weft traction device including a first rotatable roller, the weft yarn being in press contact with said first rotatable roller to draw the weft yarn from said measuring and storing means to said weft posture regulating nozzle;

means for causing said first rotatable roller to always rotate during a weaving operation of the loom;

a change-over device for alternating the weft yarn into and out of press contact with said first rotatable roller; and means disposed between said weft posture regulating nozzle and said weft traction device, for deforming a slackened portion of the weft yarn between said weft posture regulating nozzle and said weft traction device, wherein said slackened portion is formed from a difference in temporary tractive speed to the weft yarn between the weft posture regulating nozzles and said weft traction device.

2. A weft picking system as claimed in claim 1, wherein said weft yarn slackened portion deforming means includes means defining a yarn introduction opening though which the weft yarn passes, wherein the locational relationship between said weft traction device and said weft yarn slackened portion deforming means are such that a first plane is offset from a second plane said first plane being parallel with an axis of said roller and containing at least a part of a path of the weft yarn drawn from said roller, said second plane being parallel with an axis of said roller and containing an axis of said yarn introduction opening.

3. A weft picking system as claimed in claim 1, wherein said weft yarn slackened portion deforming means includes a weft yarn contacting member to which the weft yarn slackened portion contacts to deform the weft yarn slackened portion.

4. A weft picking system as claimed in claim 1, wherein said weft yarn slackened portion deforming means includes means for ejecting fluid in a direction generally perpendicular to a path of the weft yarn located between said weft traction device and said weft posture regulating nozzle.

5. A weft picking system as claimed in claim 2, wherein said weft yarn slackened portion deforming means includes a first weft yarn guide member having a generally semicylindrical guide surface projected toward said weft traction device, the slackened portion of the weft yarn being brought into contact with the guide surface to be guided along the path of the weft yarn.

6. A weft picking system as claimed in claim 5, wherein said weft yarn slackened portion deforming means includes a second weft yarn guide member having a curved guide surface generally facing the guide surface of said first weft yarn guide, member and disposed under the path of the weft yarn, the slackened portion of the weft yarn being contactable with the guide surface of said second weft yarn guide member to be guided along the path of the weft yarn.

7. A weft picking system as claimed in claim 1, wherein said weft traction device includes a second rotatable roller, said first and second rotatable rollers always rotating during operation of the loom, the weft yarn being in press contact between said rollers to be drawn under rotation of said rollers, the weft yarn alternating into and out of press contact between said rollers in response to said change-over device.

8. A weft picking system as claimed in claim 7, wherein at least one of said first and second roller includes a rubber layer at a peripheral portion thereof, further comprising means for adjusting a locational relationship between said roller having said rubber layer and the other roller, said locational relationship adjusting means includes stopper means for adjusting a vertical position of said roller having said rubber layer, relative to the other roller so as to restrict a deflection amount of said rubber layer.

9. A weft picking system as claimed in claim 7, wherein at least one of said first and second roller includes a rubber layer at a peripheral portion thereof, further comprising means for adjusting a locational relationship between said roller having said rubber layer and the other roller, said locational relationship adjusting means including means for adjusting a biasing force applied to said roller having said rubber layer, said roller having said rubber layer being in press contact with the other roller under said biasing force.

10. A weft picking system as claimed in claim 7, wherein said change-over device includes a fluid ejection nozzle for ejecting a fluid to guide the weft yarn from said measuring and storing means through said change-over device to said weft traction device.

11. A weft picking system as claimed in claim 10, wherein said change-over device includes a traverse lever which is formed with a weft guide passage through which the weft yarn is guided toward the rollers of said weft traction devices and said fluid ejection nozzle, wherein said weft guide passage and said fluid ejection nozzle are arranged such that first and second vertical planes respectively containing their axes cross at an angle not larger than 30 degrees, said first and second vertical planes being parallel with art axis around which said traverse lever rotates.

12. A weft picking system as claimed in claim 11, wherein said first and second rotatable rollers are located such that one of first and second vertical planes is closer to said change-over device than the other, said first vertical plane passing through an axis of said first rotatable roller, said second vertical plane passing through an axis of said second rotatable roller.

13. A weft picking system as claimed in claim 7 wherein said weft yarn slackened portion deforming means includes means defining a yarn introduction opening through which the weft yarn passes, wherein the locational relationship between said weft traction device and said weft yarn slackened portion deforming means are such that a first plane is offset from a second plane, said first plane being located between said first and second rollers and perpendicular to a plane passing through the axes of said first and second rollers, said second plane being parallel with the axes of said rollers and containing an axis of said yarn introduction opening.

14. A weft picking system as claimed in claim 13, wherein said first and second planes form therebetween an obtuse angle.

15. A weft picking system as claimed in claim 1, further comprising means for threading the weft yarn along a path of the weft yarn under action of a fluid, said threading means including means for generating an air stream which passes through said weft yarn slackened portion deforming means and reaches said weft posture regulating nozzle, and means for regulating a flow direction of the air stream from said weft yarn slackened portion deforming means to be directed to said weft posture regulating nozzle during a threading operation of the weft yarn.

16. A weft picking system as claimed in claim 15, wherein said air stream flow direction regulating means includes means for changing a position of said weft yarn slackened portion deforming means during the weft yarn threading operation so as to change the direction of the path of the weft yarn.

17. A weft picking system as claimed in claim 15, wherein said air stream flow direction regulating means includes at least one air ejection nozzle disposed between said weft yarn slackened portion deforming means and said weft posture regulating nozzle to eject air toward the path of the weft yarn during the weft yarn threading operation so as to change the direction of the weft yarn path.

18. A weft picking system as claimed in claim 16, wherein said weft yarn slackened portion deforming means includes a weft yarn contacting member to which the weft yarn slackened portion contacts to be deformed, wherein the position changing means includes means for changing a position of said weft contacting member during the weft yarn threading operation.

* * * * *